US011141728B2

(12) United States Patent
Schwarz et al.

(10) Patent No.: US 11,141,728 B2
(45) Date of Patent: Oct. 12, 2021

(54) CENTRIFUGO-PNEUMATIC SWITCHING OF LIQUID

(71) Applicant: Hahn-Schickard-Gesellschaft für angewandte Forschung e.V., Villingen-Schwenningen (DE)

(72) Inventors: Ingmar Schwarz, Freiburg (DE); Nils Paust, Freiburg im Breisgau (DE); Steffen Zehnle, Merzhausen (DE); Mark Keller, Freiburg (DE); Tobias Hutzenlaub, Herbolzheim (DE); Frank Schwemmer, Freiburg (DE)

(73) Assignee: Hahn-Schickard-Gesellschaft für angewandte Forschung e.V.

( * ) Notice: Subject to any disclaimer, the term of this patent is extended or adjusted under 35 U.S.C. 154(b) by 222 days.

(21) Appl. No.: 16/562,241

(22) Filed: Sep. 5, 2019

(65) Prior Publication Data

US 2019/0388886 A1 Dec. 26, 2019

Related U.S. Application Data

(63) Continuation of application No. PCT/EP2018/055344, filed on Mar. 5, 2018.

(30) Foreign Application Priority Data

Mar. 10, 2017 (DE) ..... 10 2017 204 002.5

(51) Int. Cl.
*B01L 3/00* (2006.01)

(52) U.S. Cl.
CPC ... *B01L 3/50273* (2013.01); *B01L 2200/0605* (2013.01); *B01L 2200/0684* (2013.01);
(Continued)

(58) Field of Classification Search
CPC ..... B01L 3/50273; B01L 2200/0605; B01L 2200/0684; B01L 2300/0806;
(Continued)

(56) References Cited

U.S. PATENT DOCUMENTS 9,433,940 B2 9/2016 Williams et al.
2002/0027133 A1 3/2002 Kellogg et al.
(Continued)

FOREIGN PATENT DOCUMENTS

CN 101437615 A 5/2009
CN 104169590 A 11/2014
(Continued)

OTHER PUBLICATIONS

Zehnle et al., "Pneumatic siphon valving and switching in centrifugal microfluidics controlled by rotational frequency or rotational acceleration".
(Continued)

*Primary Examiner* — Jennifer Wecker
*Assistant Examiner* — Kathryn Elizabeth Limbaugh
(74) *Attorney, Agent, or Firm* — Haynes and Boone, LLP

(57) ABSTRACT

A fluidic module for switching liquid from a liquid retaining area into which liquid can be introduced into downstream fluidic structures includes at least two fluid paths fluidically connecting the liquid retaining area to the downstream fluidic structures. One of the two fluid paths includes a siphon channel. The downstream fluidic structures are not vented or only vented via a vent delay resistor, such that when the liquid is introduced into the liquid retaining area, an enclosed gas volume results in the downstream fluidic structures. By adjusting the ratio of a centrifugal pressure effected by a rotation of the fluidic module and a pneumatic pressure prevailing in the gas volume, the liquid can be retained in the liquid retaining area or can be transferred into
(Continued)

the downstream fluidic structures via the siphon channel wherein venting takes place via the other one of the fluid paths.

18 Claims, 13 Drawing Sheets

(52) U.S. Cl.
CPC . *B01L 2300/0806* (2013.01); *B01L 2300/087* (2013.01); *B01L 2300/0877* (2013.01); *B01L 2300/14* (2013.01); *B01L 2400/0409* (2013.01); *B01L 2400/049* (2013.01)

(58) Field of Classification Search
CPC ..... B01L 2300/087; B01L 2300/0877; B01L 2300/14; B01L 2400/0409; B01L 2400/049
See application file for complete search history.

(56) References Cited

U.S. PATENT DOCUMENTS

| | | | |
|---|---|---|---|
| 2010/0240142 | A1 | 9/2010 | Saiki et al. |
| 2012/0295781 | A1 | 11/2012 | Amasia et al. |
| 2014/0352410 | A1 | 12/2014 | Esteves Reis et al. |

FOREIGN PATENT DOCUMENTS

| | | | |
|---|---|---|---|
| DE | 102008003979 | B3 | 6/2009 |
| DE | 102012202775 | A1 | 8/2013 |
| DE | 102013203293 | B4 | 8/2014 |
| DE | 102013215002 | B3 | 11/2014 |
| DE | 102013218978 | B3 | 11/2014 |
| DE | 102016207845 | A1 | 11/2017 |
| EP | 2817519 | B1 | 7/2016 |
| WO | WO 2015049112 | A1 | 4/2015 |

OTHER PUBLICATIONS

Mark et al., Centrifugo-pneumatic valve for metering of highly wetting liquids on centrifugal microfluidic platforms, Royal Society of Chemistry, Lab Chip, 2009.
Schwemmer et al., Centrifugo-pneumatic multi-liquid aliquoting—parallel aliquoting and combination of multiple liquids in centrifugal microfluidics, The Royal Society of Chemistry, Lab Chip, 2015.
Strohmeier et al., Centrifugal microfluidic platforms: advanced unit operations and applications, Royal Society of Chemistry, 2015.
Mark et al., "Aliquoting on the centrifugal microfluidic platform based on centrifugo-pneumatic valves", Microfluid Nanofluid, 2011.
Wisam Al-Fagheri et. al., "Development of a Passive Liquid Valve (PLV) Utilizing a Pressure Equilibrium Phenomenon on the Centrifugal Microfluidic Platform", Sensors 2015, 15, pp. 4658-4676.
Meng X. et al., "Conditional siphon priming for multi-step assays on centrifugal microfluidic platforms", Sensors and Actuators B—Chemical, International Journal devoted to Research and Development of Physical and Chemical Transducers, ed. 242, Nov. 2016, pp. 710-717, XP029882051.
Siphon Wikipedia (with English version "Trap_(plumbing)".
Lutz et al., Microfluidic lab-on-a-foil for nucleic acid analysis based on isothermal recombinase polymerase amplification (RPA), The Royal Society of Chemistry, Lab Chip, 2010.
Office Action dated Feb. 19, 2021 issued in the parallel Chinese patent application No. 201880031223.0 (19 pages).

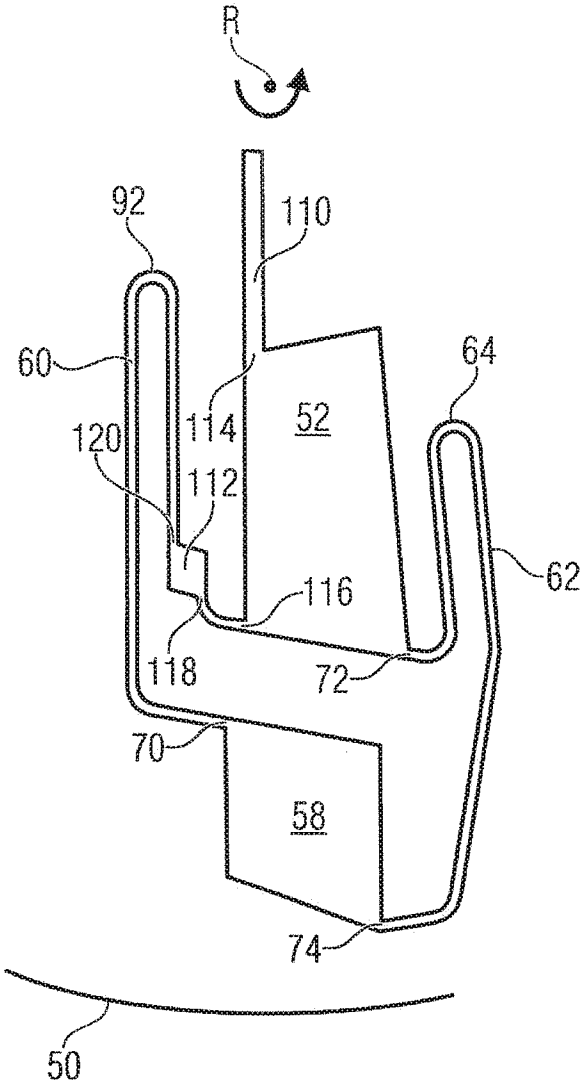
Fig. 4A
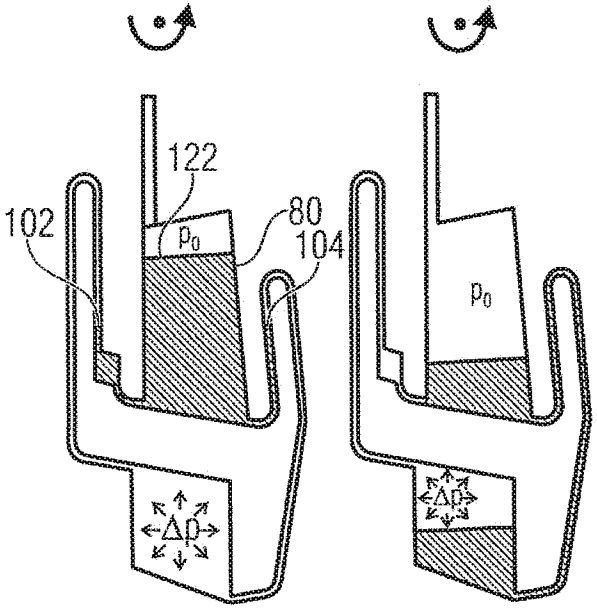
Fig. 4B
Fig. 4C
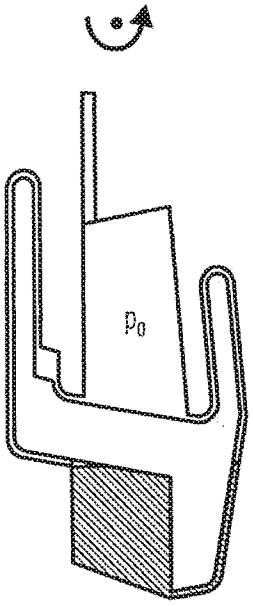
Fig. 4D

CENTRIFUGO-PNEUMATIC SWITCHING OF LIQUID

CROSS-REFERENCE TO RELATED APPLICATIONS

This application is a continuation of copending International Application No. PCT/EP2018/055344, filed Mar. 5, 2018, which is incorporated herein by reference in its entirety, and additionally claims priority from German Application No. 10 2017 204 002.5, filed Mar. 10, 2017, which is also incorporated herein by reference in its entirety.

The present invention relates to apparatuses and methods for centrifugo-pneumatic switching of liquids from a liquid retaining area into downstream fluidic structures by utilizing a ratio of centrifugal pressure to pneumatic pressure.

BACKGROUND OF THE INVENTION

Centrifugal microfluidics deal with handling liquids in the picoliter to milliliter range in rotating systems. Such systems are frequently disposable polymer cartridges used in or instead of centrifuge rotors with the intent of automating laboratory processes. Here, standard laboratory processes, such as pipetting, centrifuging, mixing or aliquoting can be implemented in a microfluidic cartridge. For that purpose, the cartridges include channels for fluid guidance as well as chambers for collecting liquids. Generally, such structures configured for handling fluids can be referred to as fluidic structures. Generally, such cartridges can be referred to as fluidic modules.

The cartridges are provided with a predefined sequence of rotational frequencies, the frequency protocol, such that the liquids within the cartridges can be moved by the centrifugal force. Centrifugal microfluidics is mainly applied in laboratory analytics and mobile diagnostics. So far, the most frequent configuration of cartridges is a centrifugal microfluidic disk used in specific processing devices and known by the terms "Lab-on-a-disk", "LabDisk", "Lab-on-CD", etc. Other formats, such as microfluidic centrifuge tubes known by the term "LabTube" can be used in rotors of already existing standard laboratory devices.

For using fluidic basic operations in a possible product, robustness and ease of handling of the process is of highest importance. Further, it is advantageous when the basic operation is realized in a monolithic manner, such that no additional components or materials are needed which would significantly increase the cost of the cartridge by material costs or additional setup and joining technology (assembly).

In particular, switching liquids is needed as a basic operation for performing process chains in order to separate sequential fluidic processing steps from one another. Thus, for automating laboratory processes in a centrifugal microfluidic rotor, switching processes are indispensable.

One example is the measurement of liquid volumes for generating aliquots wherein, after a measurement step, the liquids are advanced to subsequent process steps. Further examples are incubation and mixing processes where the incubation time or completion of the mixing process has to be reached prior to the advance.

A significant challenge in the development of cartridges for centrifugal microfluidic fluid handling is the adaption of the comprised structures to the characteristics of the fluids to be processed as well as to the interactions of the fluids with the used cartridge materials. In particular, this results in a need for structures and methods for switching fluids that are mostly independent of the characteristics of the fluids and their interactions with the cartridge material. This includes, in particular, the following characteristics of the fluids and cartridge materials: surface tension of the fluids, their angle of contact to the used cartridge materials, the viscosities of the fluids and the chemical composition of the fluids.

A further challenge for the development of microfluidic cartridges are the manufacturing requirements. Structures placing high demands on the production tolerances result in higher production costs and a higher risk of failure of the cartridges during processing. This results in a need for structures and methods for switching fluids, in particular liquids that are robust against production-related variations as regards to their function. Further, there is a need for structures that are easy to produce by established manufacturing methods allowing high production precision. In particular for the production methods injection molding and injection embossing, there is a need for structures and methods for switching fluids that can manage without sharp-edged geometry transitions in contrary to, for example, so-called capillary valves.

In the field of centrifugal microfluidics, a processing protocol generally acts on all fluidic structures of a cartridge simultaneously. Generally, the increasing integration of processing steps running sequentially or in parallel, increasingly results in limitations for the allowable processing protocols. In order to be able to still integrate different fluidic operations on a centrifugal microfluidic cartridge, there is a need for structures and methods for switching fluids for which the exact conditions for the occurrence of the switching process can be adjusted by a suitable configuration within broad limits.

Different types of switching liquids on centrifugal microfluidic platforms are known from conventional technology. An overview of active and passive as well as monolithic and nonmonlithic structures and methods can be found in O. Strohmeier et al. "Centrifugal microfluidic platforms: Advanced unit operations and applications", Royal Society of Chemistry 2015, Chem. Soc. Rev. In the following, further conventional technology will be discussed, which relates to passive monolithic structures and associated methods whose switching principle is based, among others, on an interaction between centrifugally induced pressures and pneumatic pressures.

S. Zehnle et. Al. "Pneumatic siphon valving and switching in centrifugal microfluidics controlled by rotational frequency or rotational acceleration", Springer Verlag, Microfluid Nanofluid (2015) 19, pages 1259-1269, describes several structures and associated methods for switching liquids on a centrifugal microfluidic platform. Here, in a first negative pressure valve, liquid is driven centrifugally from a first non-vented chamber, such that gas within the first chamber expands and negative pressure results in the first chamber. The liquid is driven into the second chamber through an outlet channel leading into a second vented chamber at a radial outer end. Since a siphon whose end is vented also branches off the outlet channel, part of the liquid is also driven into the siphon. At a constant rotational frequency, an equilibrium of filling levels results, such that the filling level in the second chamber is equal to the filling level in the siphon. With increasing rotational frequency, both filling levels increase. If the filling level in the siphon exceeds the siphon crest, the liquid will be driven from the first and the second chamber through the siphon and can be collected in a third vented chamber. In a second configuration of the described negative pressure valve it is shown that, with respective dimensioning of the flow resistances between the respective chambers, the siphon crest can be reached by high rotational acceleration but not at low rotational acceleration. Respective valve functions are also described in DE 10 2013 215 002 B3.

Further, in the stated paper of S. Zehnie et. al., another valve circuit is described where the liquid is driven centrifugally from a first chamber through an outlet channel into a second chamber and simultaneously into a branching-off siphon. Since in this further valve circuit the first chamber is vented and the second chamber is not vented, a gas volume is enclosed and compressed in the second chamber when driving the liquid into the second chamber. This gas volume expands when the rotational speed is reduced and drives liquid into the siphon. At a high delay rate of the rotational speed and respective dimensioning of the flow resistances, sufficient liquid is driven into the siphon to completely fill the same, such that the liquid can be driven from the first and second chambers through the siphon and can be collected in a third chamber. This valve function is also described in EP 2 817 519 B1.

Further, from DE 10 2013 203 293 B4 it is known that such a valve circuit referred to above as a further valve circuit can optionally also be provided with a second siphon in order to guide the liquid through one or both siphons, depending on the delay rate of the rotational speed.

All valve circuits described in the paper of S. Zehnle have in common that the end of the siphon through which the liquid is driven is vented. Therefore, the third chamber merely serving as a collection chamber is also vented and not coupled to a further fluidic element. Beyond the function as collecting chamber, the same has no other fluidic functions and cannot influence the described valve functions by any type of dimensioning.

In D. Mark et. al., "Aliquoting on the centrifugal microfluidic platform based on centrifugo-pneumatic valves", Springer Verlag, Microfluid Nanofluid (2011) 10, pages 1279-1288, a structure for aliquoting liquids is described, wherein the liquid flows sequentially through a supply channel into a series of measurement channels where the liquid is retained by so-called centrifuge-pneumatic valves during an aliquoting process. After completing the aliquoting process, the centrifuge-pneumatic valves are switched between the measurement channels and chambers connected to the measurement channels located radially further outside by increasing the rotational frequency and the liquids are respectively transferred into the chambers located radially further outside. The operating principle of the described centrifuge-pneumatic valves consists of two complimentary effects. The first effect is that the liquid closes the connecting channel between measurement channel and subsequent non-vented target chamber when filling the respective measurement channels and thereby the centrifugally induced transfer of liquids from the measurement finger into the target chamber results in a compression of the gas present therein. The resulting pneumatic overpressure in the target chamber counteracts further flow of the liquid into the target chamber. The second effect is that the connecting channel between measurement channel and target chamber represents a capillary valve at the opening to the target chamber which counteracts further switching of the liquid into the target chamber. The sum of both effects results in the operating principle of the centrifugo-pneumatic valve. By increasing the rotational frequency, both effects can be overcome, such that liquid is transferred into the target chamber. Respective centrifugal-pneumatic valves are described in DE 10 2008 003 979 B3 as well as in D. Mark, "Centrifugo-pneumatic valve for metering of highly wetting liquids on centrifugal microfluidic platforms", Lab Chip, 2009, 9, p. 3599-3603.

Such centrifugal-pneumatic valves allow only the compression of a low gas volume given by the connecting channel between measurement channel and target structure before liquid reaches the target chamber. Thereby, due to structural conditions, the switching frequency is limited to low frequencies. At the same time, the switching frequency depends on the liquid characteristics, since the capillary valve effect that is important for the centrifugo-pneumatic valves depends on the surface tension and the angles of contact between liquid and cartridge material. Further, from the described capillary valve portion of the centrifugo-pneumatic valves, the need for a sharp-edged transition of the connecting channel to the target chamber might result, which leads to additional production efforts.

F. Schwemmer et. al., "Centrifugo-pneumatic multi-liquid aliquoting—parallel aliquoting and combination of multiple liquids in centrifugal microfluidics", Royal Society of Chemistry 2015, Lab Chip, 2015, 15, pages 3250-3258, describe structures consisting of an inflow channel having high fluidic resistance, a measurement chamber, a pressure chamber connected to the measurement chamber via a connecting channel and an outlet channel having low fluidic resistance. The structures allow measuring and subsequent advancing of liquid volumes. The order of the measurement and switching process is as follows: First, the liquid to be measured is guided into the measurement chamber through the inlet channel at high rotational frequency, until the same is completely filled. Then, the connecting channel to the pressure chamber connected radially to the inside is filled and excess liquid is guided into the pressure chamber which presents a trap for the same, such that the liquid cannot leave the pressure chamber anymore. The gas volume in the measurement chamber and the pressure chamber displaced from the time of entry of the liquid into the measurement chamber results in a pneumatic pressure increase in the pressure chamber. After filling the structure through the inlet channel is completed, in a second step, the liquid is advanced to subsequent fluidic structures by reducing the rotational frequency. This is obtained since the centrifugal pressure in the outlet channel falls below the pneumatic overpressure in the pressure chamber and therefore the liquid is essentially transferred into the outlet channel by pneumatic overpressure and other occurring pressures. Due to the selected fluidic resistances it is ensured that the transfer essentially takes place into the outlet channel and not back into the inlet channel. Here, the structures can have a siphon ensuring, during a measurement step, that the liquid is not yet advanced into a collecting chamber. In structures where the collecting chamber is located radially further inside than the measurement chamber, the siphon can be omitted. Respective aliquoting is also described in WO 2015/049112 A1.

Due to the switching principle, such centrifugal-pneumatic aliquoting is only suitable for process chains where switching is to be performed by reducing the rotational frequency. Above that, a minimum deceleration speed has to be obtained in order to transfer the liquid into a target volume, which results in limitations for the usable processing devices. If switching is to be performed by increasing the rotational frequency, since processes prior to switching are to run at a low rotational frequency, centrifugal-pneumatic aliquoting can also not be used. Further, centrifugal-pneumatic aliquoting needs additional space for the pressure chamber which is possibly lost for introducing structures for other operations on the cartridge. The need for strong differences in the fluidic resistances between inlet and outlet channels results in additional production requirements, since high fluidic resistances are obtained by small channel cross-sections, which therefore place high demands on the production tolerances.

Wisam Al-Faqheri et. al., "Development of a Passive Liquid Valve (PLV) Utilizing a Pressure Equilibrium Phenomenon on the Centrifugal Microfluidic Platform", Sensors 2015, 15, pages 4658-4676, describe switching of liquid in dependence on a centrifugal pressure acting on a liquid in an inlet chamber, a capillary pressure acting on the liquid in the inlet chamber and a centrifugal pressure acting on a liquid in a venting chamber. Air is enclosed between the liquids in the inlet chamber and the venting chamber. By increasing the rotational speed, negative pressure generated in the inlet chamber or overpressure generated in the venting chamber is overcome to thereby transport liquid from the inlet chamber through a fluid channel into a target chamber.

SUMMARY

An embodiment may have a method for switching liquid from a liquid retaining area into downstream fluidic structures by using a fluidic module, the module having: a liquid retaining area into which liquid can be introduced, at least two fluid paths fluidically connecting the liquid retaining area to downstream fluidic structures, wherein at least a first fluid path of the two fluid paths includes a syphon channel, wherein a syphon crest of the syphon channel is located radially inside of a radial outermost position of the liquid retaining area, wherein the syphon crest is an area of the syphon channel with minimum distance to the center of rotation, wherein the downstream fluidic structures are not vented or only vented via a vent delay resistor when the liquid is introduced into the liquid retaining area, such that an enclosed gas volume or a gas volume merely vented via a vent delay resistor results in the downstream fluidic structures when the liquid is introduced into the liquid retaining area, and a ratio of a centrifugal pressure effected by a rotation of the fluidic module to a pneumatic pressure prevailing in the gas volume at least temporarily prevents the liquid from reaching the downstream fluidic structures through the fluid paths, wherein it can be effected by changing the ratio of the centrifugal pressure to the pneumatic pressure that the liquid at least partly reaches the downstream fluidic structures through the first fluid path and the gas volume is at least partly vented into the liquid retaining area through the second fluid path of the two fluid paths, the method having the steps of: introducing at least one liquid into the liquid retaining area and retaining the liquid in the liquid retaining area by rotating the fluidic module, such that the liquid is retained in the liquid retaining area in a quasi-stationary equilibrium dominated by the centrifugal pressure and the pneumatic pressure; and changing the ratio of the centrifugal pressure to the pneumatic pressure in order to transfer the liquid at least partly through the first fluid path into the downstream fluidic structures and to vent the gas volume at least partly into the liquid retaining area through the second fluid path of the two fluid paths, wherein a) retaining the liquid in the liquid retaining area includes generating a pneumatic overpressure in the downstream fluidic structures prior to initiating the transfer, and changing the ratio of the centrifugal pressure to the pneumatic pressure includes increasing the rotational speed of the fluidic module, increasing the hydrostatic height of the liquid and/or reducing the pneumatic pressure, or b) retaining the liquid in the liquid retaining area includes generating a negative pressure in the downstream fluidic structures in order to adjust and retain menisci in the liquid retaining area and the first and second fluid paths without transferring the liquid into the downstream fluidic structures through the first fluid path, and wherein changing the ratio of the centrifugal pressure to the pneumatic pressure includes reducing the rotational speed of the fluidic module and/or reducing the pneumatic pressure in the downstream fluidic structures.

Embodiments provide a fluidic module for switching liquids from a liquid retaining area into downstream fluidic structures, comprising:

a liquid retaining area into which liquid can be introduced, at least two fluid paths fluidically connecting the liquid retaining area to downstream fluidic structures, wherein at least a first fluid path of the two fluid paths comprises a siphon channel, wherein a siphon crest of the siphon channel is located radially inside of a radial outermost position of the liquid retaining area, wherein the downstream fluidic structures are not vented or only vented via a vent delay resistor when the liquid is introduced into the liquid retaining area, such that an enclosed gas volume or a gas volume merely vented via a vent delay resistor results in the downstream fluidic structures when the liquid is introduced into the liquid retaining area, and a ratio of a centrifugal pressure effected by a rotation of the fluidic module to a pneumatic pressure prevailing in the gas volume at least temporarily prevents the liquid from reaching the downstream fluidic structures through the fluid paths, wherein it can be effected by changing the ratio of the centrifugal pressure to the pneumatic pressure that the liquid at least partly reaches the downstream fluidic structures through the first fluid path and the gas volume is at least partly vented into the liquid retaining area through the second fluid path of the two fluid paths.

Embodiments of the invention are based on the knowledge that it is possible, on a centrifugal microfluidic platform, to generate, by using respective fluidic structures in response to filling a liquid retaining area which can be centrifugally induced, a pneumatic differential pressure to the environment pressure in downstream (subsequent) fluidic structures as well as the connecting fluid paths between liquid retaining area and subsequent fluidic structures, by which the liquid can be retained in the liquid retaining area under suitable processing conditions, until the liquid, induced by a suitable change of the processing conditions, can be transferred into the subsequent fluidic structures. During this transfer of liquid into the downstream fluidic structures through one of the fluid paths, venting of the downstream fluidic structures can take place through the other one of the fluid paths. By respective processing conditions, such as rotational speed and/or temperature, the ratio between pneumatic pressure and centrifugal pressure can be set or changed in order to obtain the described functionalities.

Embodiments are further based on the knowledge that, for example during a centrifugally induced filling process of the liquid retaining area, gas can be displaced into the downstream fluidic structures through the connecting fluid paths between the liquid retaining area and the downstream fluidic structures and that the displaced gas volume, merely limited by the liquid volume, can further be arbitrarily selected by suitable configuration of the connecting fluid paths, whereby processing conditions under which the liquid is retained in the liquid retaining area as well as processing conditions under which the liquid is advanced into the downstream fluidic structures can be determined within broad limits and mostly independent of liquid characteristics or cartridge material characteristics.

In embodiments, the liquid can be introduced into a fluid chamber of the liquid retaining area by a centrifugal pressure effected during rotation of the fluidic module via a radially declining inlet channel. Thereby, due to the rotation used when introducing the liquid into the liquid retaining area, the ratio between a centrifugal pressure and pneumatic pressure can be obtained, which prevents liquid from reaching the downstream fluidic structures. In embodiments, the inlet channel can further be connected to an upstream fluid chamber.

In embodiments, a second fluid path of the two fluid paths is a venting channel for the downstream fluidic structures closed by the liquid when the liquid is introduced into the liquid retaining area. Thus, it is possible to close a venting channel for the downstream fluidic structures simultaneously with introducing a liquid volume into the liquid retaining area, such that no separate means are needed.

In embodiments, the first fluid path leads into the liquid retaining area in a radial outer area or at a radial outer end, such that the liquid retaining area can be emptied via the first fluid path, at least up to the area where the first fluid path leads into the liquid retaining area. Thereby, it is possible to empty a large part of the liquid or all of the liquid from the liquid retaining area.

In embodiments, the liquid retaining area comprises a first fluid chamber, wherein the first fluid path leads into the first fluid chamber in a radial outer area of the first fluid chamber or at a radial outer end of the first fluid chamber. In such embodiments, the first fluid chamber may not be vented or may only be vented via a vent delay resistor when the liquid is introduced into the liquid retaining area, such that a gas volume enclosed in the first fluid chamber and the downstream fluidic structures or a gas volume merely vented via a vent delay resistor results when the liquid is introduced into the liquid retaining area.

In embodiments, the liquid retaining area comprises a first fluid chamber and a second fluid chamber into which liquid can be introduced by a centrifugal pressure effected by a rotation of the fluidic module, wherein the first fluid path leads into the first fluid chamber and the second fluid path into the second fluid chamber, and wherein the second fluid path can be closed by liquid introduced into the second fluid chamber. In such embodiments, the first fluid chamber and the second fluid chamber can be fluidically connected via a connecting channel whose orifice into the first fluid chamber is located radially further inside than a radial outer end of the first fluid chamber, such that liquid from the first fluid chamber flows over into the second fluid chamber when the filling level of the liquid in the first fluid chamber reaches the orifice and closes the second fluid path leading into the second fluid chamber. Such embodiments can allow that, at first, liquid is retained in the first fluid chamber and only by adding further liquid, which can be liquid differing from the first liquid, switching into the downstream fluidic structures is performed.

In embodiments, the second fluid path comprises a siphon channel. This allows increased flexibility regarding the orifice of the second fluid path into the liquid retaining area as well as increased flexibility regarding the processing conditions, since it the liquid can be prevented from reaching the downstream fluidic structures via the second fluid path. In such embodiments, the second fluid path, for example, can lead into the liquid retaining area in a radial outer area of the liquid retaining area. In such embodiments, a crest of the siphon channel of the second fluid path can be located radially further inside than a crest of the siphon channel of the first fluid path.

In embodiments, the second fluid path comprises a siphon channel and a fluid intermediate chamber is arranged in the second fluid path between the crest of the siphon channel of the second fluid path and the orifice of the second fluid path into the liquid retaining area, wherein the fluid intermediate chamber is at least partly filled with the liquid when the liquid is introduced into the liquid retaining area. The liquid intermediate chamber can have a smaller volume than a first fluid chamber of the liquid retaining area. In embodiments, a radial outer end of the fluid chamber is located radially outside the siphon crest of the first fluid path. The first fluid intermediate chamber allows that a larger amount of liquid reaches the second fluid path before its meniscus reaches the crest of the siphon channel of the second fluid path.

In embodiments, the downstream fluidic structures comprise at least one downstream fluid chamber into which the first fluid path and the second fluid path lead. Alternatively, the first and second fluid paths can also lead into different chambers of the downstream fluidic structures, as long as it is ensured that pressure compensation between the orifices of the first and second fluid paths into the downstream fluidic structures exists during the fluid retaining phase. Thus, it is possible to collect the switched liquid in the downstream fluidic structures. The first fluid path can lead into the downstream fluid chamber radially further outside than the second fluid path. Thereby, the orifice of the second fluid path into the downstream fluid chamber stays free for venting when the liquid reaches the downstream fluidic structures or is transferred to the same. The downstream fluid chamber can be a first downstream fluid chamber, wherein the downstream fluidic structures can comprise a second downstream fluid chamber fluidically connected to the first downstream fluid chamber via at least one third fluid path. Thus, it is possible to implement fluidic structures allowing cascaded switching.

In embodiments, the downstream fluidic structures can comprise a first downstream fluid chamber and a second downstream fluid chamber, wherein the first downstream chamber is fluidically connected to the second downstream fluid chamber via a third fluid path and a fourth fluid path, wherein at least the third fluid path comprises a siphon channel, wherein the third fluid path and the fourth fluid path are closed by the liquid when the liquid reaches the first downstream fluid chamber of the downstream fluidic structures through the first fluid path due to a change of the ratio of the centrifugal pressure to the pneumatic pressure, wherein an enclosed gas volume or a gas volume vented merely via a vent delay resistor results in the second downstream fluid chamber and a ratio of the centrifugal pressure to the pneumatic pressure prevailing in the gas volume in the second downstream fluid chamber at least temporarily prevents the liquid from reaching the second downstream fluid chamber through the fluid paths (in particular, the third and fourth fluid path) and wherein it can be effected by changing the ratio of the centrifugal pressure to the pneumatic pressure in the second downstream fluid chamber that the liquid at least partly reaches the second downstream fluid chamber through the third fluid path and the gas volume is vented from the second downstream fluid chamber into the liquid retaining area through the fourth fluid path. Thus, it is possible to implement fluidic structures enabling cascaded switching.

Embodiments provide an apparatus for switching liquid from a liquid retaining area into downstream fluidic structures with a fluidic module as described herein, comprising a driving means configured to provide the fluidic module with rotation and an actuator configured to effect the change of the ratio of the centrifugal pressure to the pneumatic pressure. In embodiments, the actuator is configured to increase or to reduce the rotational speed of the fluidic module in order to effect the change of the ratio of the centrifugal pressure to the pneumatic pressure. In embodiments, the actuator is configured to reduce the pneumatic pressure in the downstream fluidic structures by reducing the temperature in the downstream fluidic structures and/or by increasing the volume of the downstream fluidic structures and/or by reducing the amount of gas in the downstream fluidic structures.

Embodiments provide a method for switching liquid from a liquid retaining area into downstream fluidic structures by using a fluidic module as described herein, comprising:

introducing at least one liquid into the liquid retaining area and retaining the liquid in the liquid retaining area by rotating the fluidic module, such that the liquid is retained in the liquid retaining area in a quasi-stationary equilibrium dominated by the centrifugal pressure and the pneumatic pressure; and changing the ratio of the centrifugal pressure to the pneumatic pressure in order to transfer the liquid at least partly through the first fluid path into the downstream fluidic structures and to vent the gas volume at least partly into the liquid retaining area through the second fluid path of the two fluid paths.

In embodiments, retaining the liquid in the liquid retaining area comprises generating a pneumatic overpressure in the downstream fluidic structures prior to initiating the transfer. In embodiments, changing the ratio of the centrifugal pressure to the pneumatic pressure comprises increasing the rotational speed of the fluidic module, increasing the hydrostatic height of the liquid and/or reducing the pneumatic pressure. In embodiments, retaining the liquid in the liquid retaining area comprises generating a negative pressure in the downstream fluidic structures in order to adjust and retain menisci in the liquid retaining area and the first and second fluid paths without transferring the liquid through the first fluid path into the downstream fluidic structures, wherein changing the ratio of the centrifugal pressure to the pneumatic pressure comprises reducing the rotational speed of the fluidic module and/or reducing the pneumatic pressure in the downstream fluidic structures and/or increasing the hydrostatic height of the liquid in the liquid retaining area.

In embodiments, changing the ratio comprises reducing the pneumatic pressure by reducing the temperature in the downstream fluidic structures, increasing the volume of the downstream fluidic structures and/or reducing the amount of gas in the downstream fluidic structures.

In embodiments, the second fluid path is not completely filled with liquid during the transfer of the liquid through the first fluid path. In embodiments, the amount of gas in the downstream fluidic structures is not changed while the liquid is retained in the liquid retaining area.

BRIEF DESCRIPTION OF THE DRAWINGS

Embodiments of the present invention will be detailed subsequently referring to the appended drawings, in which:

FIGS. 4A-4D are schematic illustrations of fluidic structures according to an embodiment, wherein a fluidic intermediate chamber is arranged in a fluid path between a liquid retaining area and downstream fluidic structures;

DETAILED DESCRIPTION OF THE INVENTION

Figure 1:
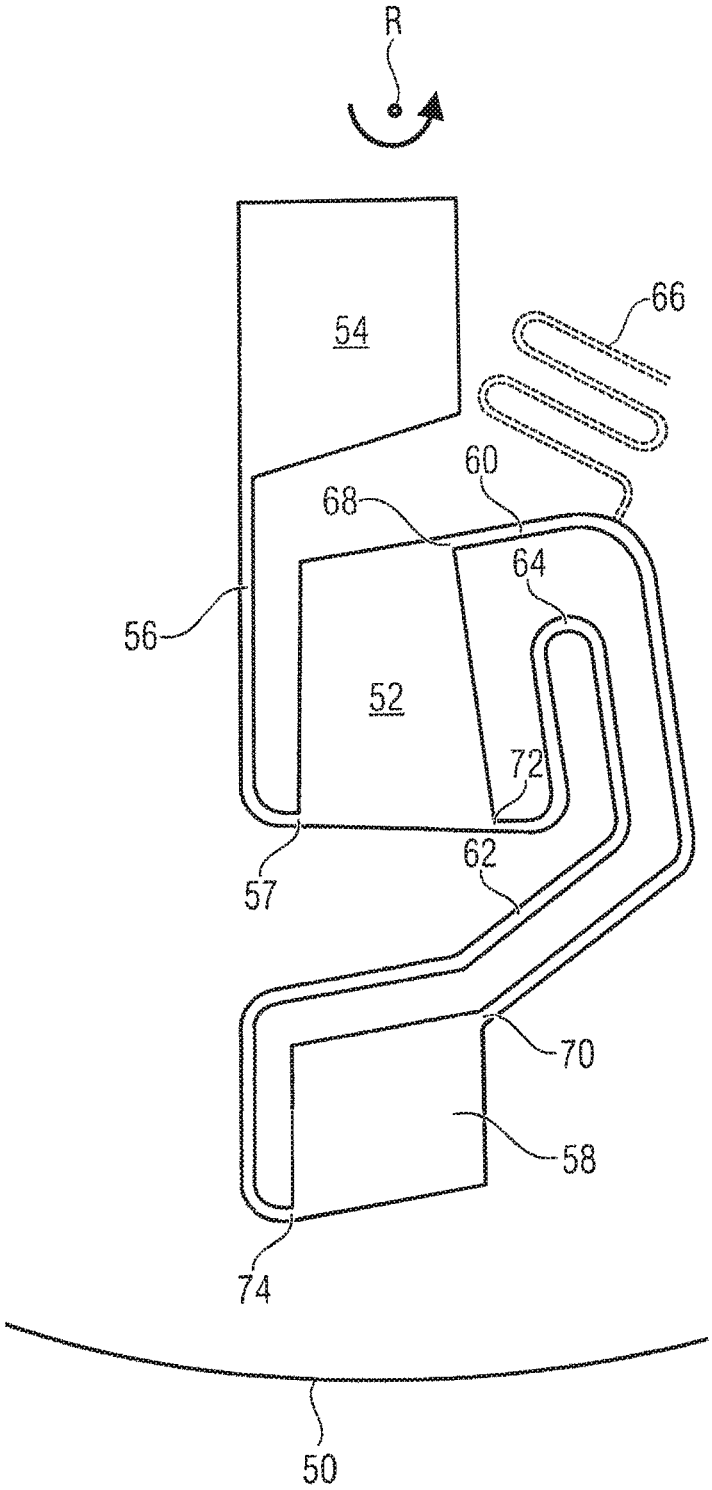
FIG. 1 is a schematic illustration of fluidic structures according to an embodiment for switching based on overpressure.

Embodiments of the invention relate to microfluidic structures for centrifuge-pneumatic switching and methods for centrifuge-pneumatic switching, in particular for centrifugo-pneumatic switching of liquids from a liquid retaining area that can comprise a first chamber to subsequent or downstream fluidic structures. Here, downstream or subsequent (wherein these expressions are used interchangeably herein) fluidic structures mean fluidic structures such as channels or chambers which liquid reaches from a preceding or upstream (wherein these expressions are used interchangeably herein) fluidic structures during handling the same. Here, the microfluidic structures can comprise a first chamber connected to the subsequent fluidic structures via at least two fluid paths, wherein at least the fluid path through which the liquid is transferred into the subsequent fluidic structures during switching is configured in the shape of a siphon. The structures and the method can be configured such that the significant pressures in the direction of or against the filling of the path for the transfer of liquid are given by centrifugal pressures or pneumatic pressures.

Switching where centrifugal pressures and pneumatic pressure dominate other pressures can be referred to as centrifugo-pneumatic switching.

In embodiments, pneumatic overpressures and/or negative pressures can be used.

In the case of using overpressures, when filling the first chamber with a liquid, gas is displaced into the subsequent fluidic structures whereby pneumatic overpressure results in the same. By suitable design within broad limits, this pneumatic overpressure can be selected and determines significantly, with otherwise unamended processing conditions, the rotational frequency (switching frequency) needed for switching the liquid. In this case, prior to the switching process, the centrifugally induced pressure in the first chamber is lower than the pressure needed to wet the crest of the siphon-shaped channel against the pneumatic overpressure in the subsequent fluidic structures, by which the liquid is transferred into the subsequent fluidic structures during the switching process. This represents a (quasi-static) equilibrium state. By increasing the rotational frequency of the cartridge via the switching frequency, the centrifugal pressure can be increased above the switching pressure, whereby the siphon is wetted and transfer of the liquid into the subsequent fluidic structures is initiated. Alternatively or in combination, the hydrostatic height of the liquid can be increased in order to initiate the transfer of liquid, for example by adding additional liquid into the liquid retaining area via upstream fluidic structures.

In the case of using negative pressure for the switching principle, in embodiments, first, the subsequent fluidic structures can be heated such that a gas contained therein expands and part of this gas can escape. When liquid is subsequently transferred into the liquid retaining area and the rotational frequency is increased, the liquid in the fluid connecting path can approximately be at the same radial height as in the liquid retaining area. When reducing the temperature and the subsequent fluidic structures, a negative pressure results which acts in the direction of the subsequent fluidic structures. However, since the connecting paths are configured in a siphon shape, this increases the hydrostatic height in the connecting paths, such that, in this case, the centrifugal force counteracts further filling of the connecting path. This is the (quasi-static) equilibrium state under negative pressure conditions. Then, by increasing the negative pressure further and/or by reducing the centrifugal pressure, a switching process can be initiated.

Embodiments present methods for retaining liquids and initiating the switching process by other changes of the processing conditions together with the associated structures. All structures and methods have in common that the second fluid connection between liquid retaining area and downstream fluidic structures can be used during the transfer to let gas escape from the downstream fluidic structures into the liquid retaining area or a fluid chamber of the liquid retaining area or to let it flow in, whereby the pneumatic pressure difference to the downstream fluidic structures can be reduced.

In the following, some definitions for terms used herein will be specified.

Hydrostatic height means the radial distance between two points in a centrifugal cartridge, if liquid of a continuous amount of liquid is located at both points. Hydrostatic pressure means the pressure difference between two points induced by a centrifugal force due to the hydrostatic height between the same. The effective fluidic resistance of a microfluidic structure is the quotient of the pressure driving a fluid through a microfluidic structure and resulting liquid flow through the microfluidic structure. Aliquoting means dividing a liquid volume into several separate individual volumes, so-called aliquots.

Metering means measuring a defined liquid volume out of a greater liquid volume. Switching frequency is the rotational frequency of a microfluidic cartridge, wherein, when exceeding the same, a transfer process of liquid from a first structure to a second structure starts. A siphon channel is a microfluidic channel or a portion of a microfluidic channel in the centrifugal microfluidic cartridge, where an entrance and exit of the channel have a greater distance from the center of rotation than an intermediate area of the channel. Siphon crest means the area of a siphon channel in a microfluidic cartridge with minimum distance from the center of rotation.

A vent delay resistor is the fluidic resistor by which a fluidic structure in which a pneumatic differential pressure to the ambient pressure prevails is vented. Here, the fluidic resistance is at least so high that reducing the differential pressure by half takes at least 0.5 seconds by merely considering venting by the fluidic resistor. This applies to any point in time during venting.

When a vent delay resistor for the downstream fluidic structures is provided in embodiments, the time course of the pressure drop in these fluidic structures can be determined, for example, in that the liquid retaining area is filled with liquid at constant temperature during centrifugation and the hydrostatic height between an upstream chamber and a fluid chamber in which the liquid is retained the liquid retaining structures is captured in the quasi-stationary equilibrium by a suitable camera system (e.g., by stroboscope exposure). From the rotational frequency and the hydrostatic height the pneumatic overpressure existing in the subsequent structures results. Thus, the degradation rate of the overpressure can also be determined from this image information which results in the magnitude of the vent delay resistor. In other embodiments, such as during switching at negative pressure, the method can be used analogously in that liquid is filled in at a specific frequency and start temperature and subsequently, defined fast cooling is generated. From the developing hydrostatic height in the connecting paths and their degradation rate, again, the magnitude of the vent delay resistor results.

All liquids that are in a quasi-static fluid state change their position within the cartridge where they are located in direct dependency on the processing conditions. This means all fluid transport processes between fluidic structures running at constant processing conditions are self-contained. Further, liquid transport processes that are a sequence of changes of processing conditions decrease, during the change of the processing conditions within at most 1s, by their respective half as soon as the change of the processing conditions is abruptly stopped.

A liquid supply path is a microfluidic structure through which liquid from the liquid retaining area flows into one or several subsequent fluidic structures while the inventive method is performed. A gas supply path is a microfluidic structure through which gas exchange between the subsequent fluidic structures and the liquid retaining area takes place while the inventive method is performed. A liquid receiving volume is a microfluidic structure providing a volume into which the liquid is transferred after triggering the inventive switching process.

Here, a microfluidic cartridge is an apparatus, such as a fluidic module comprising microfluidic structures allowing liquid handling as described herein. A centrifugal microfluidic cartridge is a respective cartridge that can be subjected to rotation, for example in the form of a fluidic module insertable into a rotation body or a rotation body.

If a fluid channel is mentioned herein, this is a structure whose longitudinal dimension from a fluid inlet to a fluid outlet is, for example, by more than 5 times or more than 10 times greater than the dimension(s) defining the flow cross-section. Thus, a fluid channel has a flow resistance for the flow through the same from the fluid inlet to the fluid outlet. On the other hand, a fluid chamber is a chamber having such dimension that during a flow through the chamber, a flow resistance neglectable compared to connected channels occurs, which can be, for example $1/100$ or $1/1000$ of the flow resistance of the channel structure with smallest flow resistance connected to the chamber.

Before embodiments of the invention will be discussed in more detail, it should be noted that examples of the invention can be applied in particular in the field of centrifugal microfluidics that deals with processing liquids in the picoliter to milliliter range. Accordingly, the fluidic structures can have suitable dimensions in the micrometer range for handling respective liquid volumes. In particular, embodiments of the invention can be applied in centrifugal microfluidic systems such as known, for example, by the term "lab-on-a-disk".

If the term radial is used herein, it means radial with respect to the center of rotation around which the fluidic module or the rotation body can be rotated. Thus, in the centrifugal field, a radial direction away from the center of rotation is radially declining and a radial direction towards the center of rotation is radially rising. Thus, a fluid channel whose beginning is closer to the center of rotation than its end is radially declining while a fluid channel whose beginning is further apart from the center of rotation than its end is radially rising. Thus, a channel comprising a radially rising portion comprises directional components that radially rise or run radially towards the inside. It is obvious that such a channel does not have to run exactly along a radial line but can also run at an angle to the radial line or in a curved manner.

With reference to FIGS. 12A, 12B, 13A and 13B, examples of centrifugal microfluidic systems or fluidic modules where the invention can be used will be described at first.

Figure 12A:
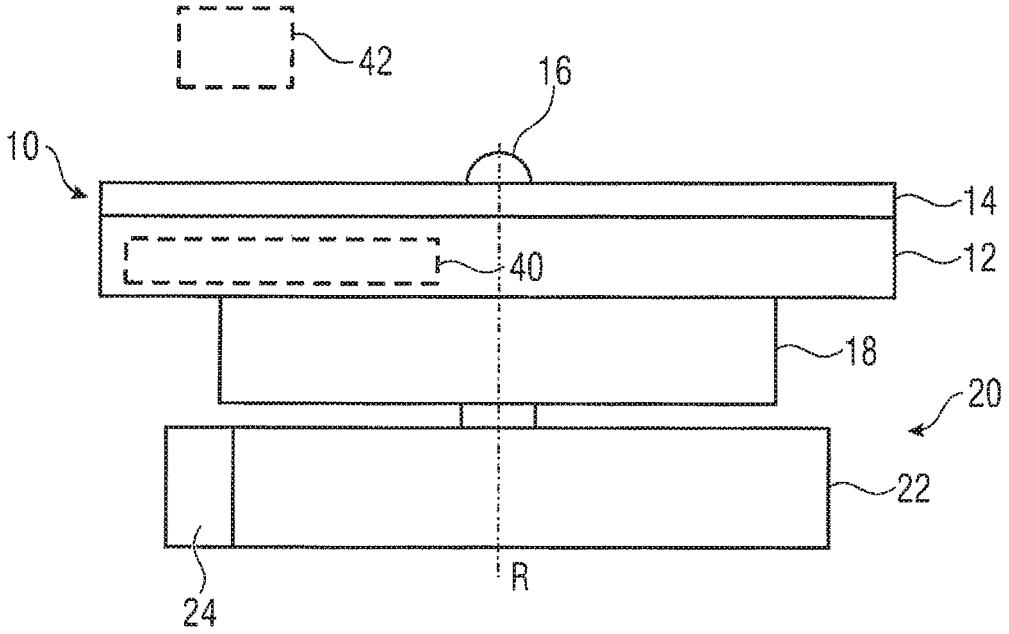
FIGS. 12A-12B are schematic side views for illustrating embodiments of apparatuses for switching liquids.
Figure 13A:
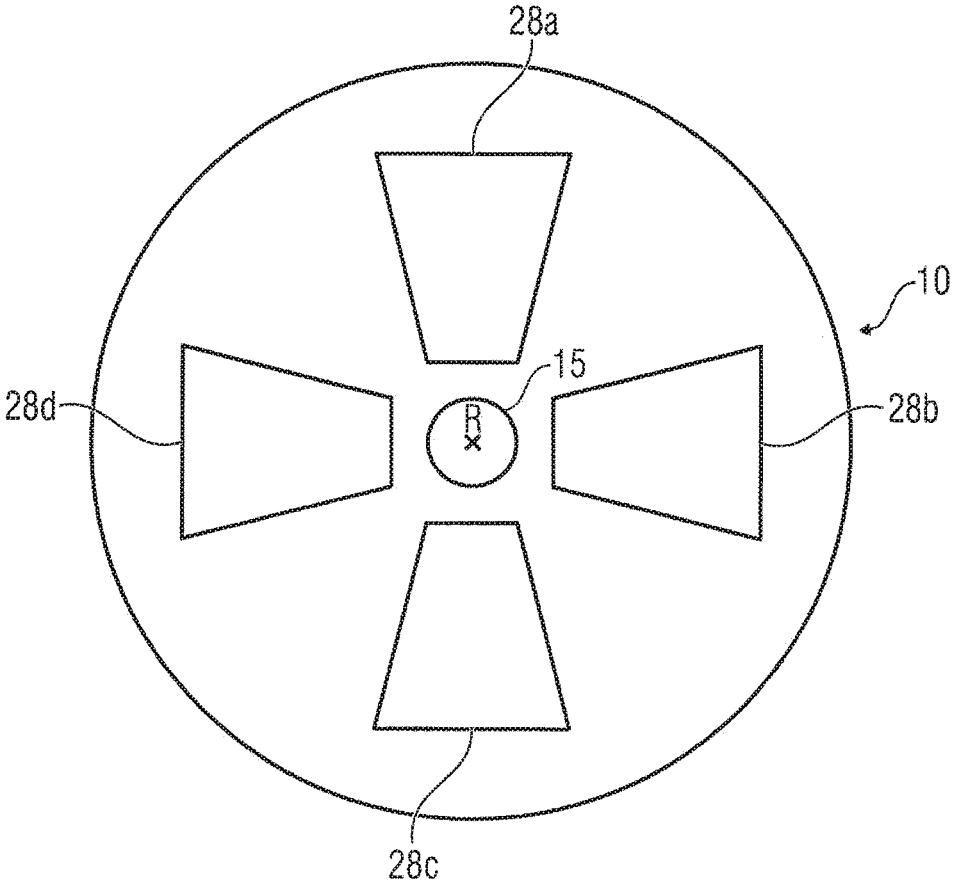
FIGS. 13A-13B are schematic top views of embodiments of fluidic modules.

FIG. 12A shows an apparatus having a fluidic module in the form of a rotational body 10 comprising a substrate 12 and a lid 14. FIG. 13A schematically shows a top view of the rotational body 10. The substrate 12 and the lid 14 can be circular in the top view, having a central opening 15 in which a center of rotation R is arranged and via which the rotational body 10 can be mounted to a rotating part 18 of a driving apparatus 20 via common mounting means 16. The rotational part 18 is rotatably supported at stationary part 22 of the driving apparatus 20. The driving apparatus 20 can, for example, be a conventional centrifuge with adjustable rotational speed or also a CD or DVD drive. A control means 24 can be provided that is configured to control the driving apparatus 20 in order to provide the rotational body 10 with rotations having different rotational frequencies. The control means 24 can be configured to perform a frequency protocol in order to obtain the functionalities described herein. As it is obvious for persons skilled in the art, the control means 24 can, for example, be implemented by respectively programmed computing means, a microprocessor or an application-specific integrated circuit. Further, the control means 24 can be configured to control the driving apparatus 20 in response to manual inputs by a user in order to effect the rotations of the rotational body. In each case, the control means 24 can be configured to control the driving apparatus 20 in order to provide the fluidic module with the rotational frequencies in order to implement embodiments of the invention as described herein. A conventional centrifuge having only one rotational direction can be used as driving apparatus 20.

The rotational body 10 comprises the fluidic structures described herein. Respective fluidic structures are indicated merely schematically in FIG. 13A by trapezoidal areas 28*a* to 28*d*. For example, several fluidic structures can be arranged next to each other in azimuthal direction as indicated in FIG. 13A in order to allow parallel handling of several liquids. The fluidic structures can be formed by cavities and channels in the lid 14, the substrate 12 or in the substrate 12 and the lid 14. In embodiments, for example, fluidic structures can be formed in the substrate 12 while filling openings and venting openings are formed in the lid 14. In embodiments, the structured substrate (including filling holes and venting holes) is arranged at the top and the lid is arranged at the bottom.

Figure 12B:
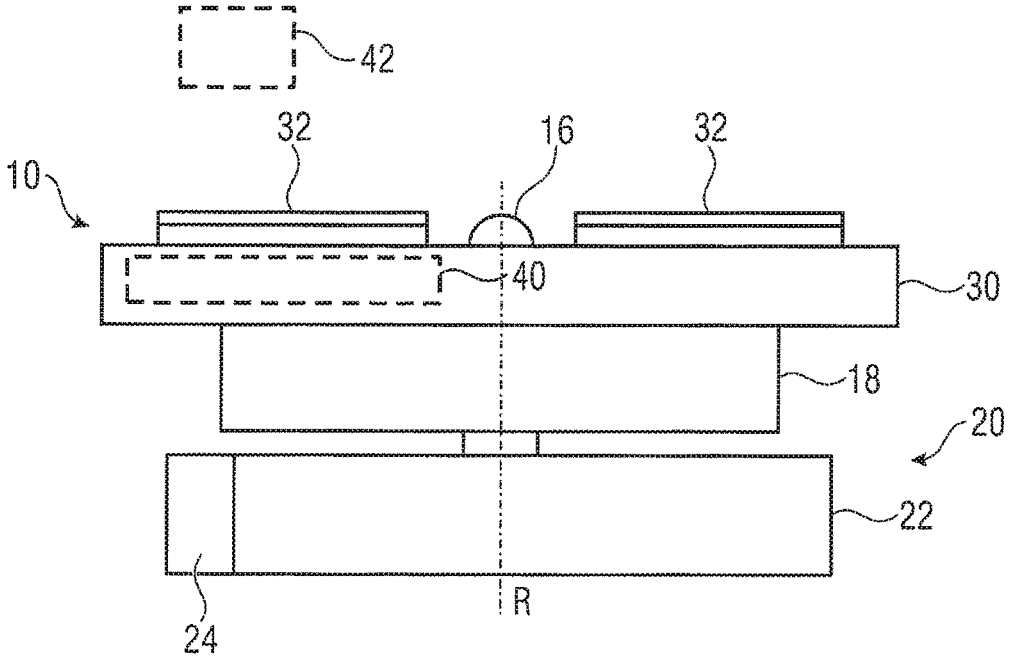
Figure 13B:
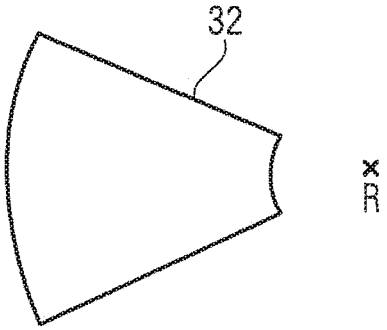

In an alternative embodiment shown in FIG. 12B, fluidic modules 32 are incorporated in a rotor 30 and form the rotational body 10 together with the rotor 30. FIG. 13B shows schematically a top view of a respective fluidic module. The fluidic modules 32 can each comprise a substrate and a lid in which again respective fluidic structures can be formed. The rotational body 10 formed by the rotor 30 and the fluidic module 32 can again be provided with a rotation by a driving apparatus 20 controlled by the control means 24.

In FIGS. 12 and 13, a center of rotation around which the fluidic module or the rotational body can be rotated is indicated by R.

In embodiments of the invention, the fluidic module or the rotational body comprising the fluidic structures can be formed of any suitable material, such as plastic like PMMA (polymethylmethacrylate), PC (polycarbonate), PVC (polyvinyl chloride) or PDMS (polydimethylsiloxane), glass or the same. The rotational body 10 can be considered as a centrifugal microfluidic platform.

As will be discussed below, in embodiments, the control means 24 is, an actuator that can adjust the rotational speed of the driving means in order to initiate the transfer of liquid, i.e., to effect the change of the ratio of the centrifugal pressure to the pneumatic pressure that effects switching of the liquid. In embodiments of the invention, the actuator can additionally comprise one or several heating means and/or cooling means for controlling the temperature of the fluidic structures to initiate the transfer of liquid. For example, one or several temperature control elements 40 (heating element and/or cooling element) can be integrated in the rotational body as show in FIGS. 12A and 12B. Alternatively or additionally, one or several external temperature control elements 42 can be provided by which the temperature of the fluidic structures can be adjusted. The external temperature control elements can, for example, be configured to control the temperature of the environment and hence also of the fluidic module. The control can be configured to control the temperature control elements 40, 42 such that the actuator can comprise the control 24 and the temperature control elements in those embodiments.

With reference to FIGS. 1 to 11, in the following, embodiments of fluidic modules (microfluidic cartridges) and fluidic structures formed therein will be described.

FIG. 1 shows schematically fluidic structures formed in a fluidic module 50. The fluidic module 50 is rotatable around a center of rotation R. The fluidic structures comprise a liquid retaining area comprising a first chamber 52. Upstream fluidic structures comprising an upstream chamber 54, which is connected to the first chamber 52 via a radially declining connecting channel 56, are connected to the first chamber 52. In a radial outer area 57, for example the radial outer end, the connecting channel 56 leads into the first chamber 52. The first chamber can be centrifugally filled via the upstream chamber and the connecting channel 56. Here, it should be noted that the first chamber can also be filled in other ways than centrifugally, wherein the fluidic module is provided with rotation only after filling in order to obtain the equilibrium between centrifugal pressure and pneumatic pressure.

Further, the fluidic module 50 comprises subsequent fluidic structures comprising a fluid chamber 58 as a fluid receiving volume and two fluid paths 60, 62 fluidically connecting the first chamber 52 to the fluid chamber 58. The fluid path 62 comprises a siphon channel whose siphon crest 64 is located radially inside the radial outermost position of the first chamber 52. The subsequent fluidic structures in the form of the fluid chamber 58 are either not vented or can be vented via a vent delay resistor 66 satisfying the above definition. Such a vent delay resistor 66 can optionally be provided in all embodiments described herein without being specifically mentioned.

In the shown embodiment, the first fluid path 60 between the first chamber and the subsequent fluidic structure 58 consist of a channel leading from a radial inner area of the first chamber 52, for example the radial innermost point 68 of the first chamber 52 to a radial inner area of the subsequent fluid chamber 58, for example to the radial innermost point 70 of the subsequent fluid chamber 58. The second fluid path 62 between the first chamber 52 and the subsequent fluid chamber 58 is connected in a radial outer area, for example at the radial outermost point 72 of the first chamber 52, to the same and leads to a radial outer area, for example the radial outermost point 74 of the subsequent fluid chamber 58 via the siphon crest 64.

A radial slope is located between the respective orifice of the two fluid paths 60 and 62 into the first fluid chamber 52 and the respective orifice into the subsequent fluid chamber 58.

Embodiments of an inventive method include introducing at least one liquid into a first chamber of the liquid retaining area. This introducing can take place by a centrifugally induced transfer of liquid into the first chamber 52. Subsequently, centrifuge-pneumatically induced retaining of the liquid in the liquid retaining area, for example the first chamber 52, can take place. Subsequently, switching the liquid into the subsequent fluidic structures, for example the subsequent fluid chamber 58 can take place. During the switching process, at least part of the liquid is transferred through at least one fluid path (e.g., fluid path 62) from the liquid retaining area (e.g., first chamber 52) into the subsequent fluidic structures (e.g., fluid chamber 58). Fluid paths through which liquid is transferred during a switching process will be referred to below as liquid guidance paths. During the switching process, gas (normally air) can be transferred from the subsequent fluid structures back to the liquid retaining area through at least one further fluid path (e.g., fluid path 62) between the liquid retaining area (e.g., first chamber 52) and the subsequent fluid structures (e.g., fluid chamber 58). Fluid paths allowing this will be referred to below as gas guidance path.

In the following, an embodiment of such a method will be described based on the operation of the fluidic module 50 shown in FIG. 1 with reference to FIGS. 2A to 2E. FIGS. 2A to 2E show fluidic operating states of the embodiment shown in FIG. 1 while the method is performed. For clarity reasons, the respective reference numbers of the fluidic structures are omitted in FIGS. 2A to 2E.

Figures 2A, 2B, 2C, 2D, 2E:
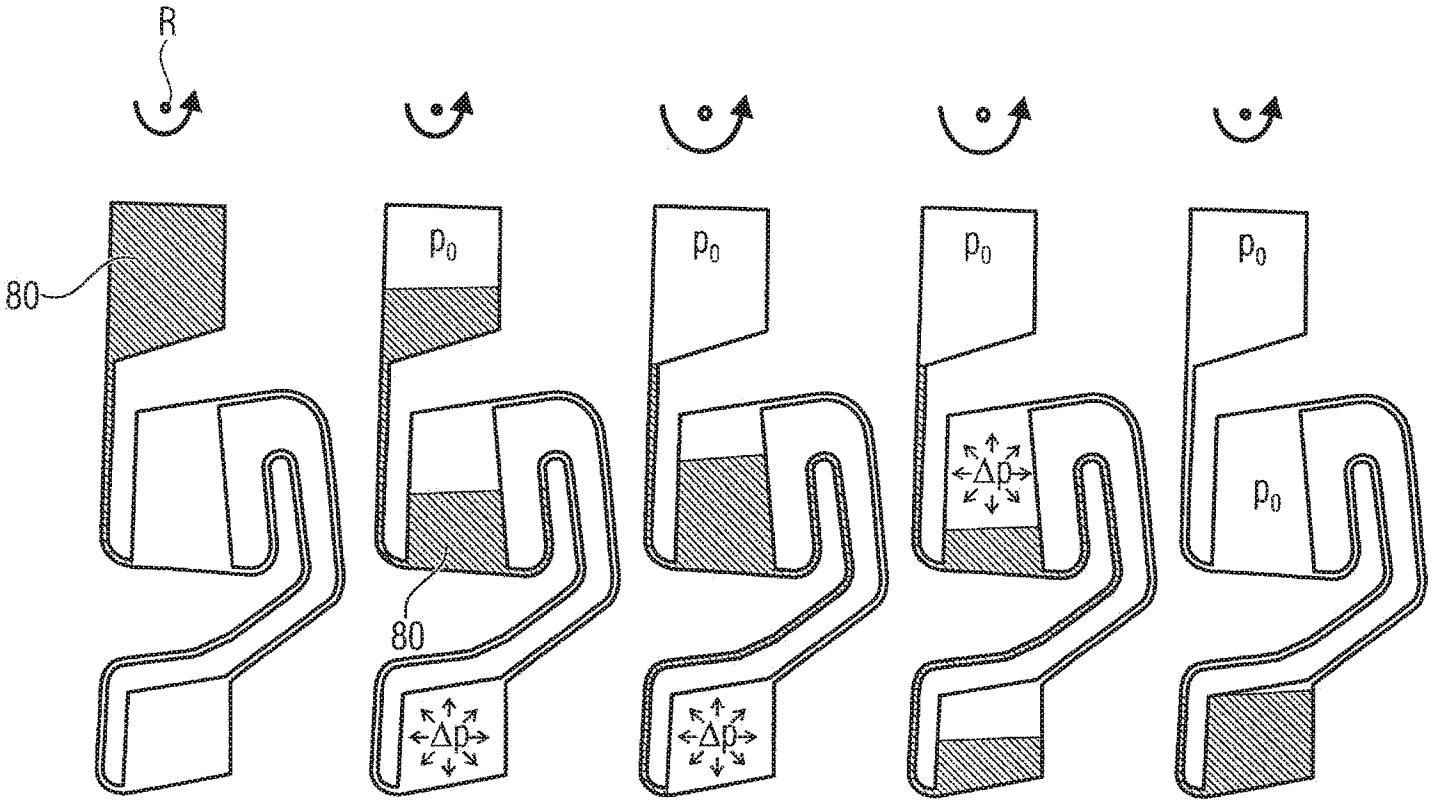
FIGS. 2A-2E are schematic illustrations for illustrating the mode of operation of the embodiment of FIG. 1.

In a first state shown in FIG. 2A, the liquid 80 is in the chamber 54 upstream of the first chamber 52 and in the connecting channel 56 between upstream chamber 54 and first chamber 52. Here, part of the upstream chamber 54 is radially closer to the center of rotation R than the siphon crest 64 of the fluid guidance channel. The liquid can be introduced into the upstream chamber 54 and the connecting channel 56, for example, via an inlet opening or via a further upstream fluidic structures. By the introduced liquid 80, an air volume that is not vented (or merely vented via a vent delay resistor) is enclosed in the first chamber 52, the fluid path 60 and 62 and the downstream fluid chamber 58. In other words, the fluid path 60 representing a venting channel is also closed towards the atmosphere by the liquid 80 within the liquid retaining area.

As shown in FIG. 2B, subsequently, the liquid 80, centrifugally induced, is transferred from the upstream chamber 54 into the first chamber 52, wherein the gas in the first chamber 52, the subsequent fluidic structures 58 as well as the connecting paths 60, 62 is compressed since the first chamber 52 is not vented or merely vented via a vent delay resistor in this operating state. The upstream chamber 54 can be vented, such that atmospheric pressure $p_o$ can prevail in the same. Here, gas is transferred into the subsequent fluidic structures 58 via the gas guidance path 60. The fluid paths 60, 62 between first chamber 52 and subsequent fluidic structures are connected to each other via the subsequent fluidic structures such that it is ensured that the same pneumatic overpressure prevails in the fluid paths. Simultaneously with filling the first chamber 52, the liquid guidance path 62 can also be filled with liquid, but not up to the siphon crest 64.

The pneumatic overpressure $\Delta p$ building up in the first chamber 52 and the subsequent fluidic structures 58 counteracts the centrifugally induced filling of the first chamber 52 as well as the filling of fluid guidance channel 62, such that the siphon crest 64 in the fluid guidance channel 62 is not wetted and the liquid within the first chamber 42 as well as in the chamber 54 upstream of the first chamber 52 is retained. Thus, these fluidic structures represent a liquid retaining area.

Retaining the liquid in the liquid retaining area is obtained in that 1) the transfer of liquid into the first chamber 52 reduces the hydrostatic height between upstream chamber 52 and first chamber 52, whereby the centrifugal pressure acting in the direction of filling the first chamber 52 is reduced, and
2) the pneumatic overpressure in the subsequent fluidic structures rises simultaneously with progressing filling of the first chamber 52, such that with suitable rotational frequency of the cartridge an equilibrium results between the pressures acting in the direction of filling the liquid guidance path 62 and the pressures counteracting the filling of the liquid guidance path. The respective suitable rotational frequency can be determined easily in dependence on the used geometries and amounts of liquid.

In all embodiments described herein, when the geometries of the chambers and the fluid guidance channels are suitably selected, it can be obtained that centrifugal pressure and pneumatic overpressure dominate with respect to other pressure sources, such as the capillary pressure taking into account arbitrary liquid characteristics and cartridge material characteristics. This means that these other pressure sources are not able to effect a deviation from the filling state of the liquid guidance path triggering a switching process which results by merely considering the equilibrium of pneumatic overpressure and centrifugal pressure. According to the invention, this equilibrium is also realized if the involved pressures are continuously varied by slight specific variations of the processing conditions, wherein the qualitative state of retaining the liquid in the liquid retaining area (e.g., the first chamber) is maintained. In other words, while retaining the liquid in a quasi-stationary equilibrium, slight variations of the processing conditions can occur without triggering the switching process.

Starting from the equilibrium state shown in FIG. 2B, the switching process can be obtained by increasing the centrifugal pressure via the switching frequency or the centrifugal switching pressure. This can be obtained for example, in that 1) the rotational frequency is increased or
2) the hydrostatic height is increased by adding liquid in the preceding fluidic structures.

By increasing the centrifugal pressure, further liquid is transferred from the chamber 54 upstream of the first chamber 52 into the first chamber, such that the filling level in the first chamber 52 and the liquid guidance path 62 increases and the siphon crest 54 of the fluid guidance channel 62 is filled, as shown in FIG. 2C.

Alternatively, the switching process can be obtained by reducing the pneumatic overpressure in the subsequent fluidic structures, such that, with constant rotational frequency, liquid is transferred, pneumatically induced, from the upstream chamber 54 into the first chamber 52 and thereby the siphon crest 64 of the liquid guidance path 62 is filled. Reducing the pneumatic overpressure can be obtained, for example, by reducing the temperature in the subsequent fluidic structures, by increasing the volume of the subsequent fluidic structures or reducing the amount of gas in the subsequent fluidic structures. The latter can take place via a vent delay resistor, for example the vent delay resistor 66 shown in FIG. 1.

As a consequence of the described process condition variations that trigger a switching process or a combination of the same, the part of the siphon shaped channel 64 in the liquid guidance path 62 running radially to the outside is filled, which increases the hydrostatic height in this channel. The centrifugal pressure resulting from the hydrostatic height between first chamber 52 and subsequent fluidic structures results in a transfer of liquid from the first chamber 52 into the subsequent fluidic structures as shown in FIGS. 2C to 2E.

During the transfer of liquid, gas is transferred from the subsequent fluidic structures via the at least one gas guidance path 60 into the first chamber 52, which counteracts the buildup of additional pneumatic overpressure as a consequence of the transfer of liquid into the subsequent fluidic structures, see FIG. 2D. Thereby, complete transfer of the liquid from the first chamber 52 into the subsequent fluidic structures can be obtained at a fixed rotational frequency above the switching frequency as shown in FIG. 2E. After the complete transfer of the liquid into the downstream fluid chamber, the fluidic structures can be at atmospheric pressure $p_o$.

The switching pressure and the associated rotational frequency of the cartridge (switching frequency) can be selected within broad limits by a suitable selection of the positions and geometries of the chambers and the fluid guidance paths.

In the following, further embodiments will be discussed in more detail. Due to the dependencies between structure and method, the specific features and specifics of the method resulting from the features are indicated together for the embodiments. Where parts of the description would be repeated in the description of the different embodiments, the same are partly omitted such that parts of the description can apply across embodiments. Although the described embodiments partly only show one fluid path between preceding fluidic structures and first chamber as well as only one liquid guidance path and one gas guidance path between first chamber and subsequent fluidic structures, this does not limit the number of possible connecting paths between the fluidic structures of the invention and merely serves to simplify the description of the embodiments.

Figures 3A, 3B, 3C, 3D:
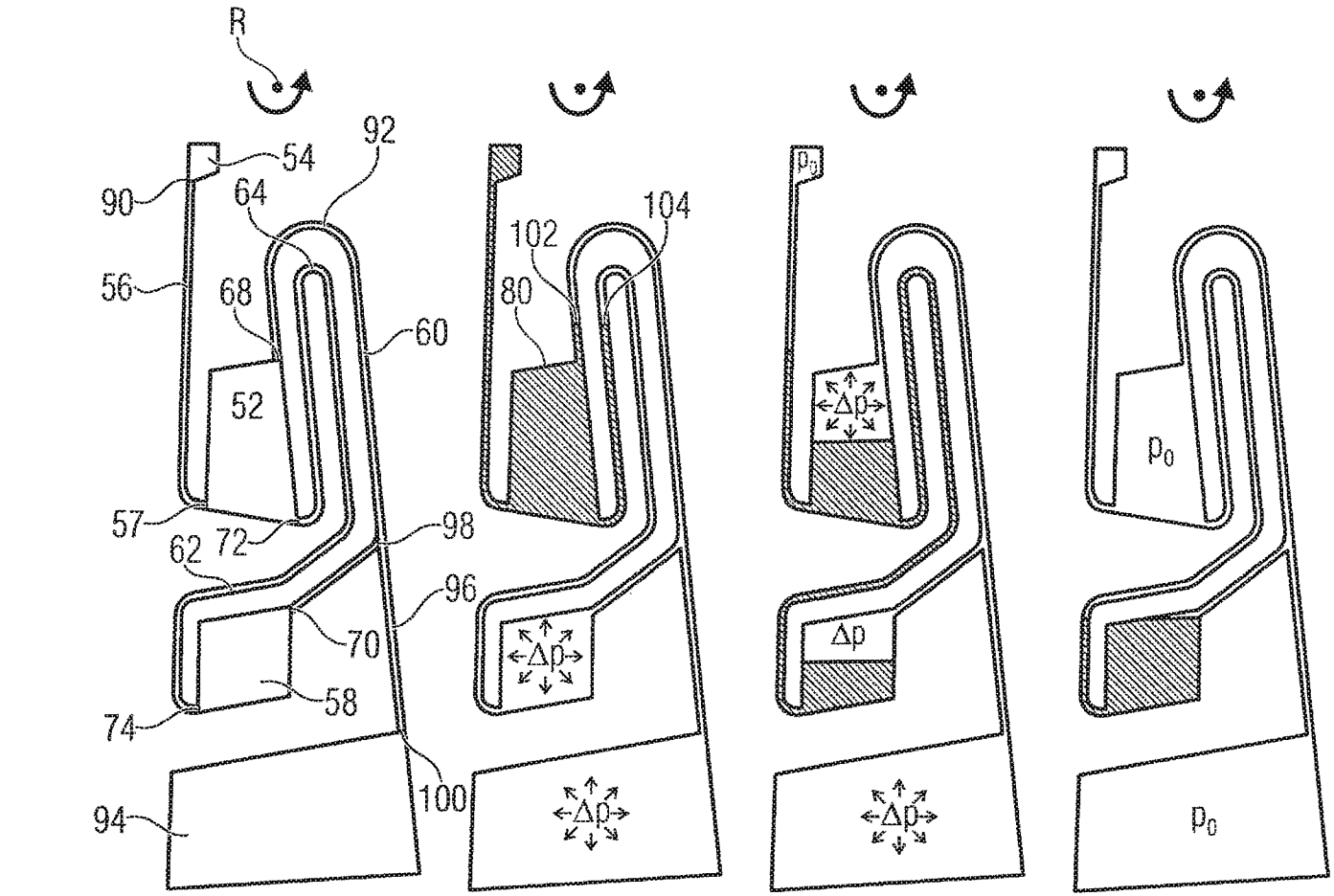
FIGS. 3A-3D are schematic illustrations of fluidic structures according to an embodiment wherein the downstream fluidic structures comprise a liquid receiving chamber and a further chamber.

FIG. 3A schematically shows an embodiment of fluidic structures of fluidic module 50 where the complete first fluid chamber 52 is filled with liquid 80 in the quasi-stationary equilibrium state shown in FIG. 3B.

In the embodiment shown in FIG. 3A, both liquid guidance path 62 and the gas guidance path 60 have a siphon-shaped channel. Again, an upstream chamber 54 is fluidically connected to the first chamber 52 via a connecting channel 56 leading into a radial outer end 90 of the upstream chamber 54. The liquid guidance path 62 and the gas guidance path 60 can lead into the first chamber 52 and the downstream chamber 58 as in the embodiment described with reference to FIG. 1. The siphon crest 64 of the liquid guidance path 62 is arranged radially inside the radial innermost point of the first chamber and a siphon crest 92 of the siphon channel of the gas guidance path 60 can be located radially inside the siphon crest 64 of the liquid guidance path 62. In this embodiment, the subsequent fluidic structures comprise, apart from the downstream fluid chamber 58 representing a liquid receiving volume or a liquid receiving chamber a further separate volume 94. The connection point of the gas guidance path 60 to the liquid receiving volume 58 (in the shown embodiment the radial innermost point of the liquid receiving volume 58) can be closer to the center of rotation R of the cartridge than the radial outermost point of the liquid receiving volume 58, whereby wetting of the connection point 70 of the gas guidance path 60 with the liquid 80 transferred during the switching process can be prevented under the influence of the centrifugal force prevailing during the transfer. The optional volume 94 separate from the liquid receiving volume 52 specifically increases the volume of the subsequent fluidic structures, whereby the pneumatic overpressure in the subsequent fluidic structures can be reduced when performing the inventive method. In the shown embodiment, the additional volume 94 is coupled to the gas guidance path 60 via a fluid path 96. The fluid path 96 leads into the gas guidance path 60 at an orifice 98, and into the additional volume 94 at an orifice 100.

In the embodiment shown in FIGS. 3A to 3D, the preceding fluidic structures comprise the chamber 54 whose volume includes a fraction of the volume of the first chamber 52, and that is connected to the first chamber 52 via the fluid path 56 whose connection point 90 to the upstream chamber 54 is closer to the center of rotation R of the cartridge then the crest of the siphon 64 in the liquid guidance path 62. In alternative embodiments, the volume of the chamber 54 can also be greater than the volume of the first chamber 52. Again, the chamber 54 can be vented and can be at the atmospheric pressure. The connection point 57 of the fluid connecting path 56 between preceding chamber 54 and first chamber 54 can be located at any position of the first chamber 52 and does not have to be arranged in a radial outer area of the same.

The embodiment of a pneumatic counterpressure siphon valve shown in FIGS. 3A to 3D is configured for compressing the complete volume of the first chamber. FIG. 3B shows an operating state where an equilibrium exists between pneumatic overpressure in the subsequent fluidic structures and the pressures in the direction of filling the subsequent fluidic structures. FIG. 3C shows an operating state where the liquid is transferred from the first chamber into the subsequent fluidic structures and FIG. 3D shows an operating state after the transfer of liquid is completed.

During operation, liquid 80 is introduced into the first fluid chamber 52 via the upstream fluidic structures. Here, the fluidic structures are configured such that the first fluid chamber 52 is completely filled with the liquid 80. By the introduced liquid, a gas volume is enclosed in the downstream fluidic structures. In FIG. 3B, the state is illustrated where the liquid 80 is retained in the first chamber 52. The cartridge or the fluidic module can be in rotation at a rotational frequency $\omega_1$. Liquid is in the chamber 54 of the preceding fluidic structures, the first fluid chamber 52 and the portions of the liquid guidance path 62 and the gas guidance path 60 running radially to the inside. Due to the hydrostatic difference in height between the liquid meniscus at the preceding fluidic structures and menisci 102, 104 in the fluid connecting paths 60 and 62, a centrifugal pressure acts in the direction of filling the fluid connecting paths 60 and 62. The pressures counteracting filling the siphon with greater radial distance from the center of rotation R (i.e. the siphon and the liquid guidance path 62) (pneumatic overpressure $\Delta p$ and possibly further pressures e.g., capillary pressure) are in equilibrium with the pressures acting in the direction of filling this siphon (centrifugal pressure and possibly others). Thereby, the liquid is in a quasi-stationary equilibrium.

By the position of the liquid menisci 102, 104 in the fluid connecting path 60, 62, the described structure for dimensioning the amount of liquid in the first chamber 52 and the fluid connecting paths can be used, whereby high accuracy of the measured volume can be obtained.

Starting from the state shown in FIG. 3B, by increasing the rotational frequency to a value $>\omega_1$, which results in an increase of the centrifugal pressure in the direction of the subsequent fluidic structures, or by reducing the counterpressure in the subsequent fluidic structures, the siphon crest 64 of the liquid guidance path 62 can be filled. Then, the liquid can subsequently be transferred from the first chamber 52 into the liquid receiving volume 58 by the acting centrifugal force as shown in FIG. 3C. During this process, the gas is transferred from the liquid receiving chamber 58 via the gas guidance path 60 into the first chamber 52 which counteracts an increase of the pneumatic overpressure in the liquid receiving chamber 58. During this transfer of liquid, the gas volume remains enclosed in the subsequent or downstream fluidic structures and the first chamber at first, such that a pneumatic overpressure $\Delta p$ prevails in the same as indicated in FIG. 3C. After completing the transfer of liquid, a compensation of the pneumatic overpressure of the subsequent fluidic structures and the first chamber with the preceding fluidic structures takes place via the connecting channel 56. After the transfer of liquid, the fluidic structures are at atmospheric pressure $p_o$ as shown in FIG. 3D.

In the following, an embodiment wherein a compression chamber volume is provided in the gas guidance path will be described with reference to FIGS. 4A to 4D.

FIG. 4A shows fluidic structures formed in a fluidic module 50 comprising an inlet channel 110, a first fluid chamber 52, a liquid guidance path 62, a gas guidance path 60, a downstream fluid chamber 58 and a volume chamber 112 arranged in the gas guidance path 60. The inlet channel 110 can again be fluidically coupled to an upstream chamber (not shown in FIG. 4A). Thus, again, a fluidic connection to preceding fluidic structures can be given by the channel 110 whose connection point to the first fluid chamber 52 is radially inside the siphon crest 64 of the liquid guidance path 62. Downstream fluidic structures are again formed by the downstream fluid chamber 58 representing a liquid receiving chamber.

The liquid receiving chamber 58 is connected to the gas guidance path 60 at an orifice point. The orifice point is not located at the radial outermost position of the liquid receiving chamber 58, for example in a radial inner area of the same or at the radial innermost position 70. The liquid receiving chamber 58 is further fluidically connected to the liquid guidance path 62, advantageously radially outside the connecting position 72 between the liquid guidance path 62 and the first fluid chamber 52. The liquid guidance path 62 can lead into the liquid receiving chamber 58 at a radial outer position, for example at the radial outermost position 74.

In the embodiment shown in FIG. 4A, the liquid receiving path 62 leads into the first fluid chamber 52 in a radial outer area, for example the radial outermost position 72, and the gas guidance path 60 also leads into the first fluid chamber 52 at a radial outer position, for example the radial outermost position 116 of the area of the first fluid chamber 52 that is on the left side in FIG. 4A. The gas guidance path 60 comprises a siphon channel whose siphon crest 92 is located radially inside the siphon crest 64 of the liquid guidance path 62. The volume chamber 112 which can also be referred to as partial compression chamber is arranged in the radially rising part of the siphon channel of the gas guidance path 60, wherein the gas guidance path 60 leads into the partial compression chamber 112 at orifice points 118 and 120. The partial compression chamber 112 is located at a greater radial distance from the center of rotation than the siphon crest 64 of the liquid guidance path 62. The partial compression chamber 112 can be connected to the first fluid chamber 52 by a part of the gas guidance path 60, wherein the connection point where this part of the gas guidance path leads into the partial compression chamber 112 is located radially further apart from the center of rotation than the siphon crest 64 of the fluid guidance path 62. The orifice point 120 can then be connected to the downstream fluidic structures via the siphon channel of the gas guidance path 60 comprising the siphon crest 92.

One embodiment of an inventive method using fluidic structures as shown in FIG. 4A will now be described with reference to FIGS. 4B to 4D. First, centrifugally induced liquid can be transferred from upstream fluidic structures (not shown) via the inlet channel 110 into the first fluid chamber 52. Under the influence of the centrifugal force, the liquid 80 fills the first chamber from the radial outer side in the direction of the radial inner side. Thereby, the fluid paths 60 and 62 connecting the first fluid chamber 52 to the subsequent fluidic structures, for example the downstream fluid chamber 58, are filled and gas (normally air) is enclosed by the liquid 80 in the downstream fluidic structures and the fluid connecting paths 60 and 62. By the rise of the hydrostatic height between the liquid meniscus 122 in the first fluid chamber 52 and the menisci 102, 104 in the fluid connecting paths 60 and 62, liquid is transferred into the partial compression chamber 112 under the influence of the centrifugal force, whereby gas located in the same is displaced into the subsequent fluidic structures. Thereby, pneumatic overpressure $\Delta p$ counteracting a further filling of the fluid connecting path 60 and 62 is generated in the same. An equilibrium is formed between the pressures in the direction of and against the filling of the fluid paths 60 and 62 where the siphon crest 64 of the liquid guidance path 62 is not wetted and the meniscus 122 of the liquid in the first fluid chamber 52 is located radially inside the siphon crest 64 of the liquid guidance path 62. This operating state is shown in FIG. 4B. By the liquid 80, a gas volume is enclosed in the fluid path 60, 62 and the downstream fluidic structures 50 where the pneumatic overpressure Δp is generated. Since the first fluid chamber 52 is vented, the area of the first fluid chamber 52 above the liquid meniscus 122 is at atmospheric pressure $p_o$.

By a suitable selection of the partial compression volume 112 and the volumes of the downstream fluidic structures, the pneumatic overpressure Δp prevailing in the subsequent fluidic structures in the equilibrium can almost be freely selected.

By increasing the rotational frequency, starting from the operating state shown in FIG. 4B, the centrifugal pressure can be increased in the direction of filling the liquid guidance path 62, whereby the siphon crest 64 of the liquid guidance path 62 is filled and a centrifugally induced transfer of the liquid into the subsequent fluidic structures 58 is started. In embodiments, the partial compression chamber 112 has a lower liquid volume than the first fluid chamber 52. Due to the transfer of liquid from the first fluid chamber 52 into the downstream fluidic structures via the liquid guidance path 62, an additional pneumatic overpressure is built up in the enclosed volume of the subsequent fluidic structures, which results in a transfer of the liquid from the partial compression chamber 112 into the first fluid chamber 52. As soon as the pneumatic overpressure Δp in the downstream fluidic structures exceeds the hydrostatic pressure acting in the first fluid chamber 52 on the gas guided path 60, gas is transferred from the subsequent fluidic structures 58 via the gas guidance path 60 into the first fluid chamber 52 and through the liquid, wherein this operating state is shown in FIG. 4C. The operating state after the transfer of liquid is completed is shown in FIG. 4D.

Figures 5A, 5B, 5C, 5D:
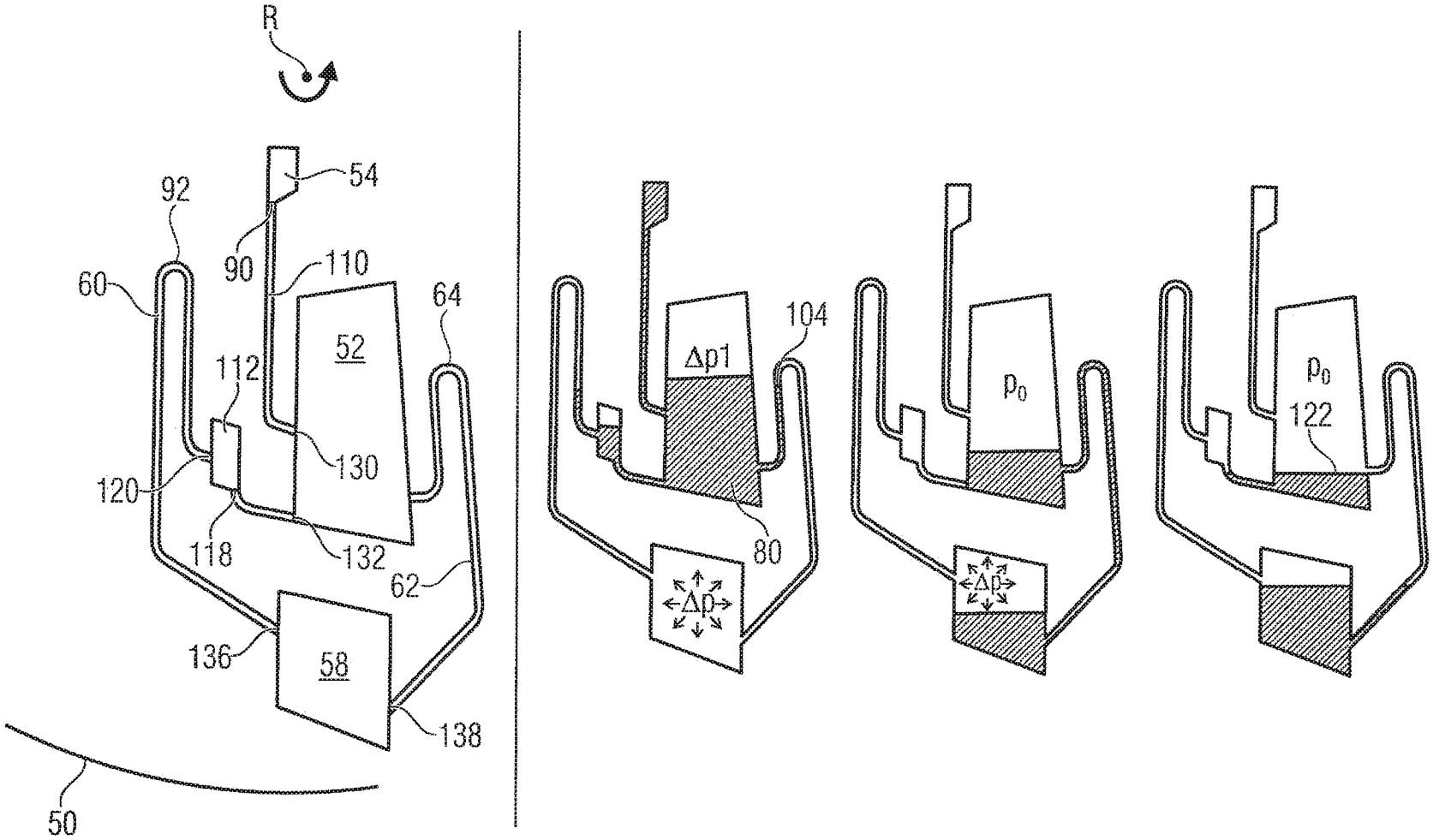
FIGS. 5A-5D are schematic illustrations of fluidic structures according to an embodiment with changed connecting positions of the fluid path.

With reference to FIGS. 5A to 5D, an embodiment with connecting position variations of the fluid path will be described. The fluidic structures shown in FIG. 5A show a possible selection of variation options when selecting the connecting positions between the first fluid chamber 52 and the fluid connecting paths 60 and 62 as well as when configuring the gas guidance path 60 and the connections between the fluid connecting paths 60 and 62 and the downstream fluidic structures 58.

In embodiments, the connecting position 132 between the preceding fluidic structures (for example the inlet channel 110 and the upstream fluid chamber 54) and the first fluid chamber 52 can be located at a freely selectable positions of the first fluid chamber 52. The same applies to connecting positions 132, 134 of the connecting paths 60, 62 between first fluid chamber 52 and subsequent fluidic structures 58 to the first fluid chamber 52. In the case that a partial compression chamber 112 exists in the gas guidance path 60, the connection points 132 and 180 of the connections between first fluid chamber 52 and partial compression chamber 112 and the connection points 120, 132 between partial compression chamber 112 and the subsequent fluidic structures 58 can also be freely selected. The orifice point 136 of the gas guidance path 60 into the downstream fluid chamber 58, i.e., the liquid target volume, is not located at the radial outermost position of the liquid target volume. Further, the connecting position 138 of the liquid guidance path 62 into the downstream fluid chamber 58 can be freely selected. The connecting position 134 is in a radial outer area of the first fluid chamber 52 since the first fluid chamber 52 can only be emptied up to this connecting position above the liquid guidance path 62.

Based on FIGS. 5B to 5D, an embodiment of an inventive method will be described based on the operation by using the fluidic structures shown in FIG. 5A. First, liquid that is centrifugally induced from the upstream fluidic structures, for example the upstream chamber 54, is transferred into the first fluid chamber 52 and the fluid connecting paths 60 and 62 connected therewith. Here, the filling level of the first fluid chamber 52 rises continuously in radial direction from the radial outermost point of the same towards positions located radially further inside. During the filling process, the gas within the first fluid chamber 52 is displaced by the inflowing liquid, whereby gas is transferred into the connections of the fluid connecting paths 60, 62 between the first fluid chamber 52 and the downstream fluidic structures that have no yet been wetted by liquid. Thereby, during the filling process of the first fluid chamber 52, pressure compensation results between the first fluid chamber 52 and the subsequent fluidic structures as long as the filling level in the first fluid chamber 52 is located radially outside of the radial innermost connection point.

As shown in FIG. 5A, the connecting position 134 of the liquid guidance path 62 to the first fluid chamber 52 can be closer to the center of rotation R than the connecting position 132 of the gas guidance path 60. Further, more liquid can be transferred into the first fluid chamber 52 than can be received by the first fluid chamber 52 and the fluid connecting paths 60, 62 to the radial position of the connection point located radially further inside (the connection point 134 of the embodiment shown in FIG. 5A). In this case, the first fluid chamber 52 can still be configured without any further vents, such that a pneumatic overpressure $\Delta p_1$ that is not identical with the pneumatic overpressure Δp in subsequent fluidic structures can build up in the gas volume enclosed by the liquid with continued transfer of liquid from the upstream fluidic structures into the first fluid chamber 52. During the filling of the first fluid chamber 52, further, the partial compression chamber 112 in the gas guidance path 60 can be filled with liquid, whereby gas is transferred into the subsequent fluidic structures. By selecting the connection point 120 of the fluid path 60 between the partial compression chamber 112 and the downstream fluidic structures 58 at a position located radially outside the innermost point of the partial compression chamber 112, compression of gas can occur in the partial compression chamber 112 analogously to described processes in the first fluid chamber, as soon as the filling level of the liquid in the partial compression chamber 112 is located radially inside the radial innermost connection point to the partial compression chamber 112.

By respective filling of the liquid retaining area comprising the first chamber 52 and the partial compression chamber 112, an equilibrium state can be obtained where the meniscus 104 of the liquid is located in the area of the siphon-shaped area of the liquid guidance path 60 running radially towards the inside and the pressures acting in the direction of wetting the siphon crest 64 (centrifugal pressure and possibly other pressures, such as the overpressure $\Delta p_1$) are in equilibrium with the pressures acting against the wetting (the pneumatic overpressure in the subsequent fluidic structures and possibly other pressures). This operating state is shown in FIG. 5B.

Starting from the state shown in FIG. 5B, analogously to the above description, by increasing the centrifugal pressure or reducing the pneumatic counterpressure, wetting of the siphon crest 64 of the liquid guidance path 62 can be obtained, whereby transfer of liquid from the first fluid chamber 52 into the liquid target volume 58 of the downstream fluidic structures is initiated. Thereby, the level in the first fluid chamber 52 can fall below the connection point 130 of the inlet channel 110 into the first fluid chamber 52, such that venting of the first fluid chamber 52 to atmospheric pressure $p_0$ takes place. As discussed above with reference to the embodiment described in FIGS. 4A to 4D, as soon as the pneumatic overpressure in the downstream fluidic structures exceeds the hydrostatic pressure acting on the gas guidance path 60 in the first fluid chamber 52, gas from the subsequent fluidic structures can be transferred into the first fluid chamber via the gas guidance path and through the liquid, wherein this operating state is shown in FIG. 5C.

Since in the embodiment shown in FIGS. 5A to 5D the connection point 134 between the liquid guidance path 62 and the first fluid chamber 52 is located radially inside the radial outermost point of the first fluid chamber 52, the transfer can stop as soon as the liquid meniscus 122 in the first fluid chamber 52 reaches the radial position of the connection point 134. As shown in FIG. 5D, this can result in retaining liquid in the first fluid chamber 52, which results in the possibility, by multiple use of the same fluidic structure with different liquids, of mixing the same in the first fluid chamber 52. This can also be used for generating dilution series if, in a first step, a volume of a liquid to be diluted defined by a fluidic structure remains in the first fluid chamber after the transfer step and, in the following steps, the liquid used for diluting is transferred into the first fluid chamber by the preceding fluidic structures and mixed with the liquid to be diluted. For that purpose, the downstream fluidic structures can be given by cascading the described structures, i.e. by instances of the described structure offset radially to the outside.

Figure 6:
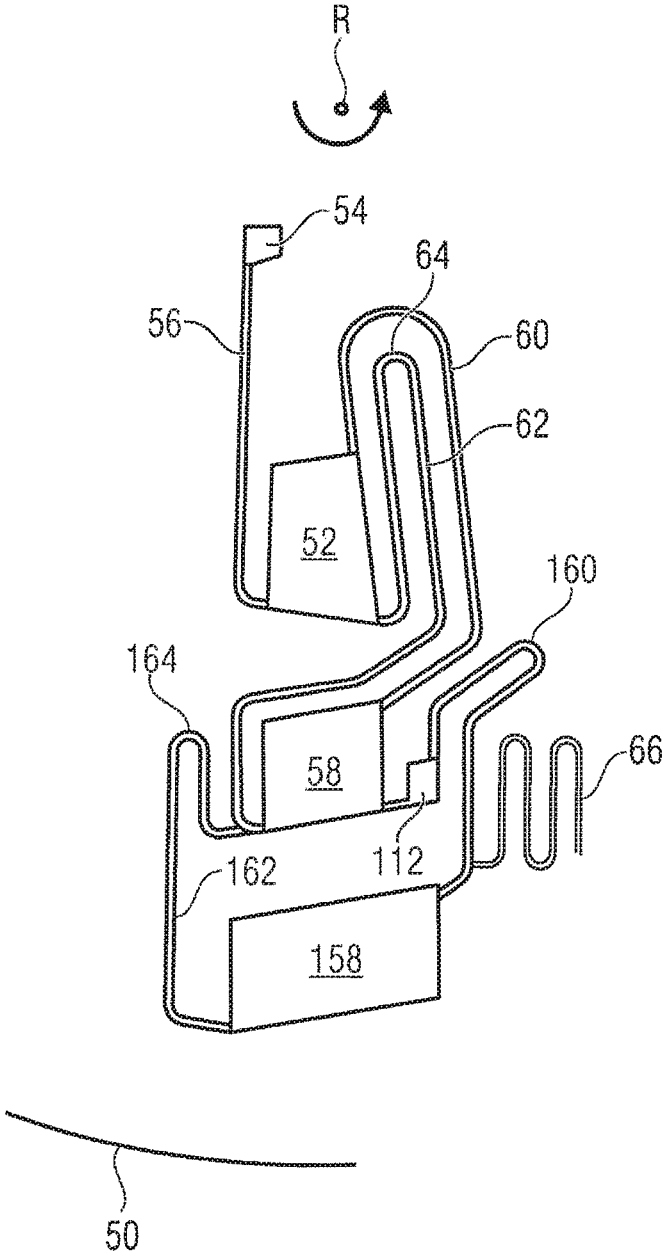
FIG. 6 is a schematic illustration of fluidic structures according to an embodiment with cascaded structures.

FIG. 6 shows an embodiment of cascaded fluidic structures in a fluidic module 50. Here, the cascaded fluidic structures represent essentially a combination of the embodiments described with reference to FIGS. 3A to 3D and 4A to 4D. Here, the setup of the upstream fluid chamber 54, the connecting channel 56, the first fluid chamber 52, the gas guidance path 60, the liquid guidance path 62 and the downstream fluid chamber 58 corresponds to the setup of the respective structures described above with reference to FIGS. 3A to 3D. These elements form a first switching structure in the cascaded fluidic structures show in FIG. 6. A gas guidance path 160, a liquid guidance path 162 and a further downstream fluid chamber 158 form a second switching structure. As shown in FIG. 6, optionally, a vent delay resistor 66 can be provided. An intermediate compression chamber 112 is arranged in the gas guidance path 160. The setup of the gas guidance path 160, the intermediate compression chamber 112 and the liquid guidance path 162 can essentially correspond to the setup of the gas guidance path 60, the intermediate compression chamber 112 and the gas guidance path 62 described above with reference to FIG. 4A. As shown in FIG. 6, the liquid guidance path 162 can lead into the downstream fluid chamber 58 in a radial outer area, for example the radial outermost position, and can lead into the downstream fluid chamber 158 in a radial outer area, for example the radial outermost position. The gas guidance path 160 can lead into the downstream fluid chamber 58 in a radial outer area, for example, the radial outermost position, and can lead into the downstream fluid chamber 158 in a radial inner area, for example the radial innermost position. All in all, the fluid paths 160 and 162 have a radial incline, i.e., the orifice of the same into the fluid chamber 158 is radially further to the outside then the orifice of the same into the fluid chamber 58.

Figures 7A, 7B, 7C, 7D, 7E:
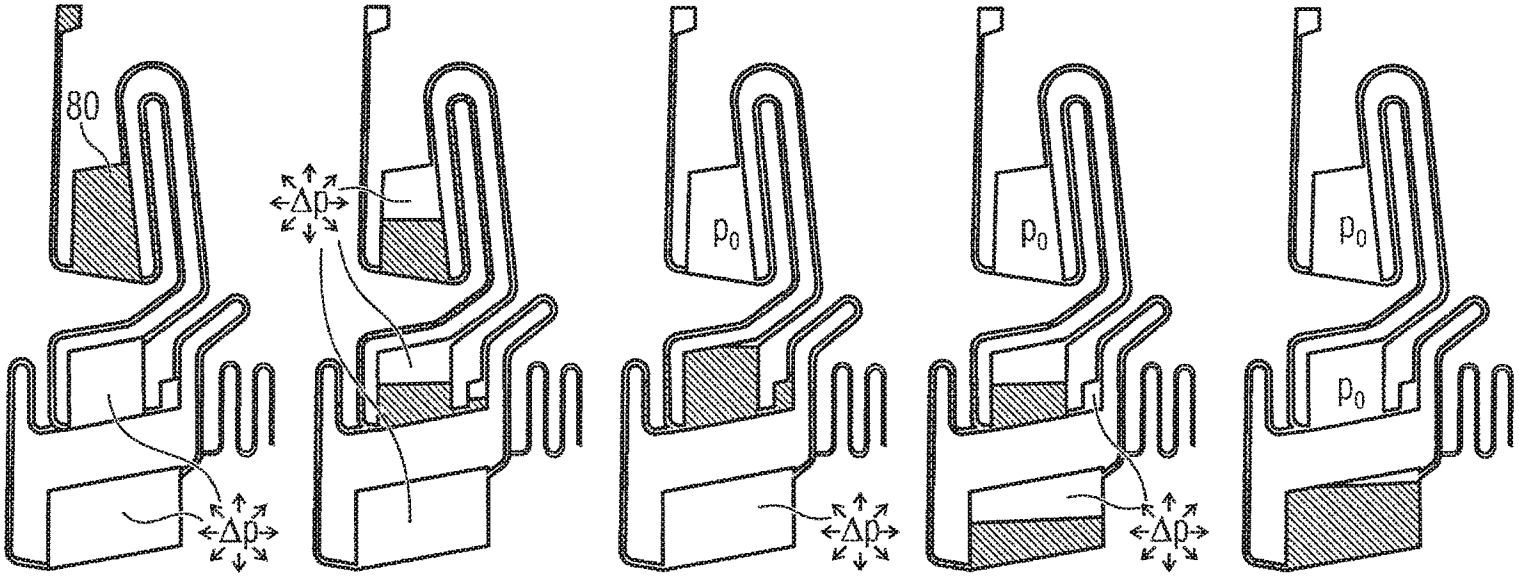
FIGS. 7A-7E are schematic illustrations for illustrating the mode of operation of the embodiment of FIG. 6.

Thus, the fluidic structures shown in FIG. 6 represent two cascaded switching structures, wherein the fluid chamber 58 represents a downstream fluidic structure for the first switching structure and a liquid retaining area for the second switching structure. With reference to FIGS. 7A to 7E, an embodiment of an inventive method for cascaded switching of liquids will be described below. FIGS. 7A to 7E show an illustration of fluidic processes during the method for cascaded switching of liquids by using the vent delay resistor 66. FIG. 7A shows the liquid 80 in the first fluid chamber 52 of the first switching structure. FIG. 7B shows a transfer of liquid into the liquid target chamber 58 of the first switching structure simultaneously illustrating the first fluid chamber of the second switching structure. FIG. 7C shows the final state of the first switching process simultaneously representing the equilibrium state prior to initiating the second switching process. FIG. 7D shows the transfer of the liquid into the liquid target chamber 158 of the second switching structure. FIG. 7E shows the final state after the second transfer of liquid is completed.

In the method shown with reference to FIGS. 7A to 7E, due to the presence of a development delay resistor, a second switching process can be implemented.

First, analogously to the above described method, liquid that is centrifugally induced is transferred into the first fluid chamber 52 and the fluid connecting paths 60, 62 and the gas prevailing in the same is displaced into the subsequent fluidic structures whereby a pneumatic overpressure is generated within the same which counteracts further filling and hence wetting of the siphon crest 64 in the liquid guidance channel 62. The downstream fluidic structures comprise the downstream fluid chamber 58, the fluid path 160, 162 and the downstream fluid chamber 158. After the first fluid chamber 52 has been completely filled with liquid, the quasi-static state shown in FIG. 7A is reached. The pressures acting in the direction of wetting the siphon crest 64 of the liquid guidance path 62 are in a quasi-static equilibrium with the pressures counteracting this wetting, whereby the pneumatic overpressure in the downstream fluidic structures slowly reduces across the vent delay resistor 66. As a consequence, with constant or also reducing rotational frequency, due to the reduction of the pneumatic counterpressure, wetting of the siphon crest 64 of the liquid guidance path 62 and associated therewith initiating the transfer process into the downstream fluid chamber 58, i.e., the first liquid target volume, can be obtained. This operating state is shown in FIG. 7B. Further, alternatively or in combination, the other process condition changes described herein for initiating the switching process can be used, for example, increasing the rotational frequency or reducing the pneumatic overpressure, for example, by reducing the temperature.

During the first transfer process, as described above with reference to FIGS. 3A to 3D, gas is vented via the gas guidance path 60 through the first fluid chamber 52. During this first transfer process, overpressure still existing from the first gas displacement process can be partly maintained in the subsequent fluidic structures of the second switching structure since no complete vent has to occur during the transfer. This is illustrated in FIG. 7C by the pneumatic overpressure $\Delta p$ remaining in the downstream fluid chamber 158. Within the centrifugally induced first transfer process, still analogously to the processes described above with reference to FIGS. 4A to 4D, the first fluid chamber of the second switching structure, i.e. the fluid chamber 58, and the partial compression chamber 112 of the second gas guidance path 60 is filled with liquid and the gas previously contained therein is displaced into the downstream fluidic structures 158. The building pneumatic overpressure Δp results in the quasi-static state shown in FIG. 7C where the pressures counteracting the wetting of the siphon crest 164 of the liquid guidance path 106 are in quasi-static equilibrium with the pressures acting in the direction of wetting. Due to the continuous slow vent of the pneumatic overpressure in the subsequent fluidic structures 158 of the second switching structure (due to the vent delay resistor 66), again, wetting of the siphon crest 164 of the liquid guidance path 162 can be obtained with constant or decreasing rotational frequency, whereby the second transfer of liquid into the downstream fluid chamber 158, i.e., the liquid target structure of the second switching structure can be obtained. During this transfer of liquid, gas can be vented from the fluid chamber 158 via the gas guidance path 160 into the fluid chamber 58. The operating state of the transfer of liquid is illustrated in FIG. 7D. The operating state after completing the second transfer of liquid into the liquid chamber 158 is shown in FIG. 10E.

Thus, with reference to FIGS. 6 to 7E, an embodiment for cascaded switching structures has been described. No need to say that also other embodiments described herein can be cascaded, wherein any process condition variations can be used for initiating the respective switching processes described herein. Although in the described embodiment a cascaded structure using a vent delay resistor as actuator is described, this is not mandatory.

Generally, according to the invention, transfer of liquid is effected by changing the ratio of the centrifugal pressure to the pneumatic pressure. The change of this ratio can take place in different ways. In embodiments, the ratio can be changed by increasing a rotational speed of the fluidic module. For that purpose, for example, a driving means by which the fluidic module is rotated can be controlled accordingly by means of a respective control means.

Alternatively or additionally, it is possible to reduce the pneumatic pressure to change the ratio. For that purpose, a vent delay resistor can be provided which can be considered as actuator that is configured to reduce the pneumatic pressure. Alternatively or in combination, the pneumatic pressure can be reduced by controlling, in particularly reducing, the temperature of the enclosed gas volume. This can take place by controlling either the temperature of the entire fluidic module or at least parts of the fluidic module where the gas volume is enclosed. For that purpose, as described above with reference to FIGS. 12A and 12B, temperature control elements can be provided. Alternatively or in combination, reduction of pneumatic pressure can be obtained by increasing the volume of the downstream fluidic structures. The downstream fluidic structures can comprise, for example, one or several fluid chambers whose volume can be adjusted.

With reference to FIGS. 8A to 8E, an embodiment will be described below where a negative pressure is used in the downstream fluidic structures, i.e., a reduction of the pressure in the downstream fluidic structures below the atmospheric pressure. In such embodiments, switching can take place by using temperature and/or centrifugal pressure variations.

As already described, temperature-controlled reduction of the pressure in the subsequent fluidic structures that serves to initiate the transfer of liquid from the first fluid chamber into the liquid target volume can be obtained by reducing the temperature of the gas in the subsequent fluidic structures.

Figures 8A, 8B, 8C, 8D, 8E:
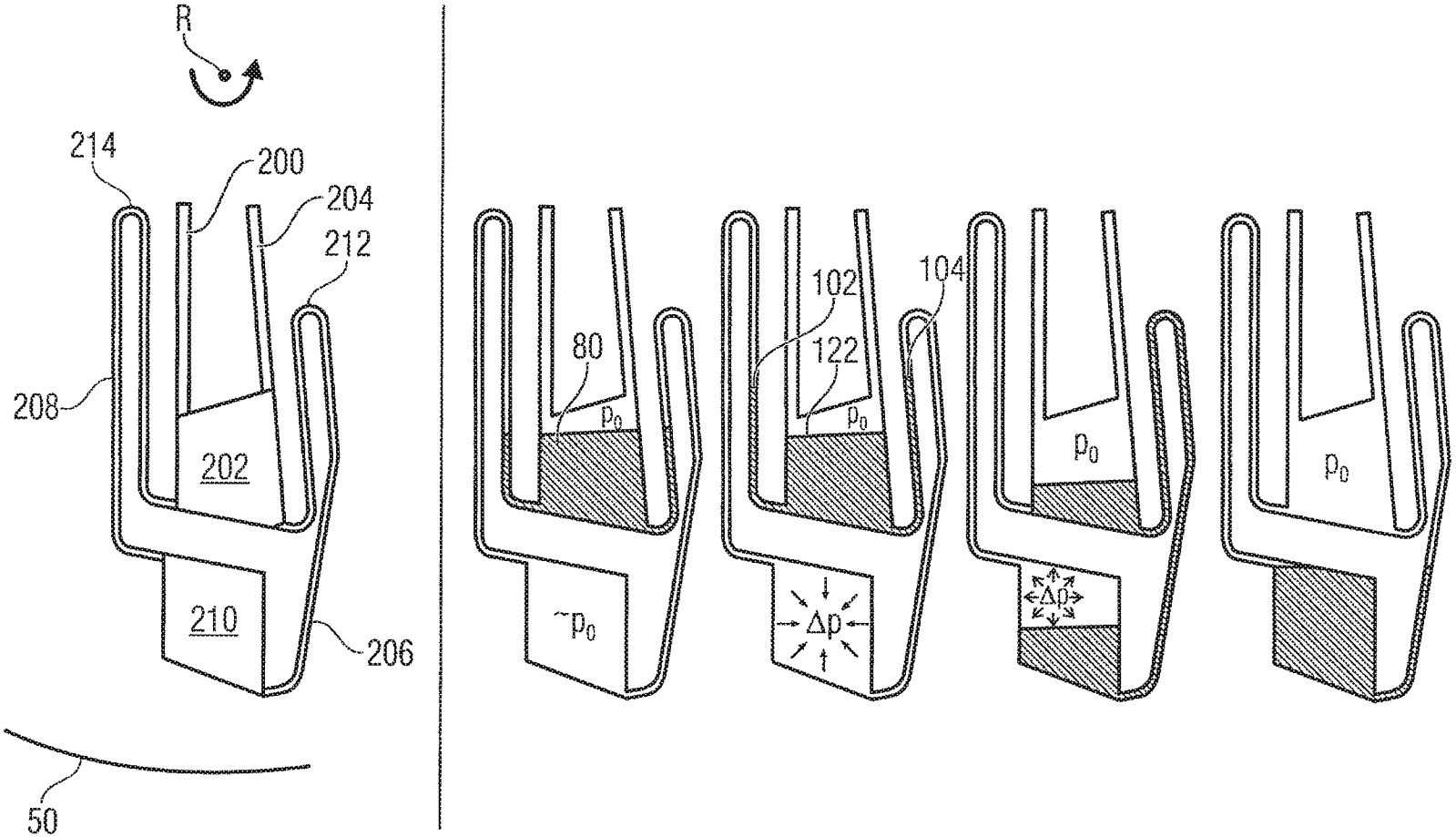
FIGS. 8A-8E are schematic illustrations of fluidic structures according to an embodiment for switching based on negative pressure.

As shown in FIG. 8A, the fluidic structures formed in a fluidic module 50 comprise an inlet channel 200 connecting a first fluid chamber 202 with preceding fluidic structures (not shown). The first fluid chamber 202 can be vented via a fluid path 204. The first fluid chamber 202 is connected to downstream fluidic structures 210 comprising a fluid receiving chamber via a first fluid path 206 and a second fluid path 208. The first fluid path 206 comprises a siphon channel with a siphon crest 212. In the shown embodiment, the second fluid path 208 also comprises a siphon channel whose siphon crest 214 is arranged radially further to the inside than the siphon crest 212 of the first fluid path 206. The first fluid path 206 represents a liquid guidance path and the second fluid path 214 represents a gas guidance path. The fluid connecting paths 206 and 208 do not have to include any further chambers. The liquid guidance path 212 is connected to the first fluid chamber in a radial outer area, advantageously at the radial outermost position. The gas guidance path 208 is connected to the first fluid chamber 202 in an area of the same which is wetted with liquid when the first fluid chamber 202 is filled. Such filling of the first fluid chamber can take place centrifugally induced via the inlet channel 200. Possible positions for the orifices of the fluid paths 206 and 208 into the first fluid chamber 202 result from the chamber geometry and the amounts of liquid used in the method. The siphon crest 212 of the liquid guidance path 206 is radially inside the position reached during the operation by the meniscus of the liquid in the first fluid chamber, in particular during a first processing step during which the liquid is retained in the first fluid chamber 202 representing a liquid retaining area. As shown in FIG. 8A, the gas guidance path 208 can lead into the downstream fluidic structures 210 in a radially inner area and the liquid guidance path 206 can lead into the downstream fluidic structures 210 in a radial outer area.

The fluidic structures shown in FIG. 8A represent fluidic structures for centrifugo-pneumatic vent siphon valve switching based on negative pressure as will be illustrated in the following description of an embodiment of an inventive method by using the fluidic structures shown in FIG. 8A.

In a first step, liquid that is centrifugally induced is transferred from upstream fluidic structures (not shown) through the inlet channel 200 into the first fluid chamber 202. Here, liquid is also transferred into the areas of the siphon-shaped connecting paths 206, 208 between the first fluid chamber 202 and the subsequent fluidic structures 210 which run radially towards the inside. From the time of wetting the connection point of the last of the connecting paths 206, 208, the further liquid flowing into the connecting paths displaces the gas contained in the connecting paths into the downstream fluidic structures, which results in an overpressure in the subsequent fluidic structures at constant temperature as shown in FIG. 8B. This overpressure as a difference to the atmospheric pressure can be a small fraction of the atmospheric pressure such that a negligible overpressure results during the introduction.

Starting from the operating state shown in FIG. 8B, at constant rotational speed, cooling of the subsequent fluidic structures 210 can be obtained, for example by reducing the environmental temperature or by cooling elements in contact with the cartridges, which results in a negative pressure in the subsequent fluidic structures as indicated in FIG. 8C. Consequently, in dependence on the processing conditions (e.g., rotational frequency, geometry of the chambers and channels, start and end temperature in the subsequent fluidic structures, etc.) a new hydrostatic height results between the menisci 102, 104 in the fluid guidance paths 206, 208 and the meniscus 122 of the liquid in the first fluid chamber 202 which results in a new equilibrium between the pressures in the direction of filling the siphon crest 212 of the liquid guidance path 206 (in this embodiment the pneumatic negative pressure in the subsequent fluidic structures and possibly other subordinate pressures) and the pressures against this filling (in this embodiment the centrifugal pressure due to the varying hydrostatic height and possibly other subordinate pressures), as shown in FIG. 8C. Starting from the operating state existing under these process conditions, in a following step, wetting of the siphon crest 212 of the liquid guidance path 206 can be obtained by reducing the centrifugal pressure, for example by reducing the rotational frequency or by reducing the pressure in the subsequent fluidic structures further, for example by a further temperature reduction, and thereby transfer of the liquid from the first fluid chamber 202 into the downstream fluidic structures 210. Alternatively or additionally, liquid can be guided into the fluid chamber 202 in order to wet the siphon crest, wherein the filling level can be increased above the siphon crest. During the transfer of liquid, the transferred liquid can result in a compression of the gas existing in the subsequent fluidic structures 210, such that an overpressure can result within the same which results in a transfer of gas from the downstream fluidic structures via the gas guidance path 208 into the first fluid chamber 202 as shown in FIG. 8D. In the following, the first fluid chamber 202 empties itself completely into the downstream fluidic structures via the liquid guidance path 206 as shown in FIG. 8E.

In the embodiment described above, the liquid retaining area comprises a first fluid chamber. In alternative embodiments, the liquid retaining area can comprise several fluid chambers which can be connected via one or several fluid channels or not.

An embodiment where the liquid retaining area comprises several fluid chambers and wherein a switching by temperature-controlled pressure reduction can take place will be discussed below with reference to FIG. 9.

Again, respective fluidic structures are formed in a fluidic module 50. The fluidic structures comprise upstream fluidic structures, a liquid retaining area and downstream fluidic structures. The liquid retaining area comprises a first fluid chamber 300 and a second fluid chamber 302. The first fluid chamber 300 and the second fluid chamber 302 are fluidically connected via a radially declining connecting channel 304. The upstream fluidic structures comprise an upstream fluid chamber 306 which can comprise, in a radially outer area of the same with respect to a center of rotation R, chamber segments 306*a* and 306*b* allowing the measurement of liquid volumes. The chamber segment 306*a* is fluidically connected to the first fluid chamber 300 via a fluid channel 308 and the chamber segment 306*b* is fluidically connected to the second fluid chamber 302 via a fluid channel 310. A further inlet channel 312 can be fluidically connected to the first fluid chamber 300. A further inlet channel/vent channel 314 can be fluidically connected to the second fluid chamber 302. A vent opening 316 is shown schematically in FIG. 9. Further, a further filling/venting channel 318 can be provided.

Figure 9:
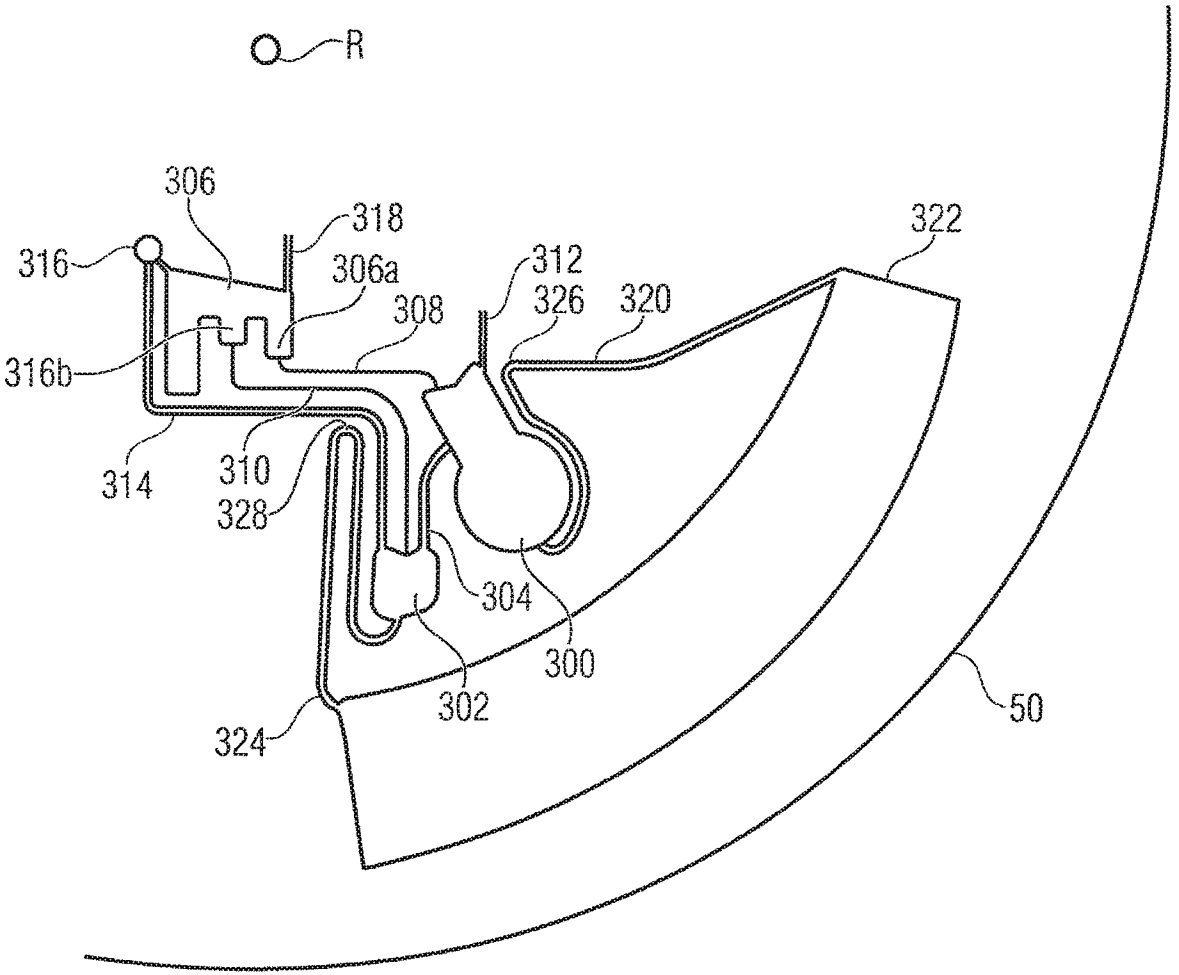
FIG. 9 is a schematic illustration of fluidic structures according to an embodiment having a liquid retaining area comprising two fluid chambers.

Here, it should be noted that the upstream fluidic structures in the embodiments shown in FIG. 9 could also consist of merely one inlet channel fluidically connected to the first fluid chamber 300 and allowing filling of the first fluid chamber 300, for example centrifugally induced filling from an inlet chamber fluidically connected to the respective inlet channel.

As shown in FIG. 9, the first fluid chamber 302 is connected to downstream fluidic structures 322 in the form of a downstream fluid chamber via a liquid guidance path 320. The second fluid chamber 302 is connected to the downstream fluidic structure 322 via a gas guidance path 324. The liquid guidance path 320 comprises a siphon channel with a siphon crest 326. In the shown embodiment, the gas guidance path 324 also comprises a siphon channel with a siphon crest 328. The obtainable hydrostatic height difference between the meniscus in chamber 302 and the siphon crest 322 is higher than the hydrostatic height difference to be overcome between the meniscus in chamber 300 and the siphon crest 326.

Figure 10A:
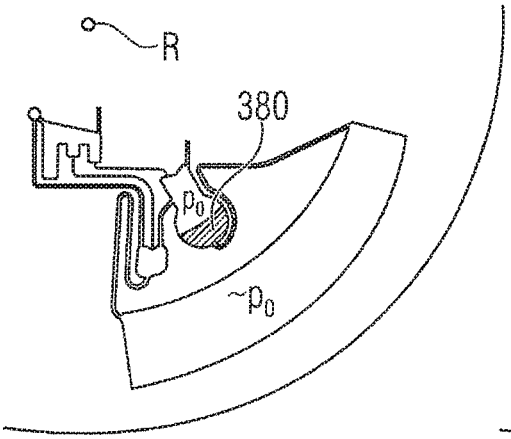
FIGS. 10A-10D are schematic illustrations for illustrating the mode of operation of the embodiment of FIG. 9.

The liquid guidance path 320 leads into the first fluid chamber 300 in a radial outer area, advantageously at a radial outer end. The gas guidance path 328 leads into the second fluid chamber 302 in a radial outer area, advantageously at a radially outer end. The first fluid chamber 300 can be configured such that when filling the same with first liquid volume, the downstream fluidic structures 322 remains vented to the second fluid chamber 302 via the gas guidance path 324. This operating state where a first liquid volume 380 is introduced in to the first fluid chamber 300 is shown in FIG. 10A. Changes of the temperature and/or rotational frequency can still be performed without switching liquid into the downstream fluidic structures 322. For the case that capillary forces are negligible, the liquid is virtually stored in the fluid chamber 300 in this state.

Figure 10B:
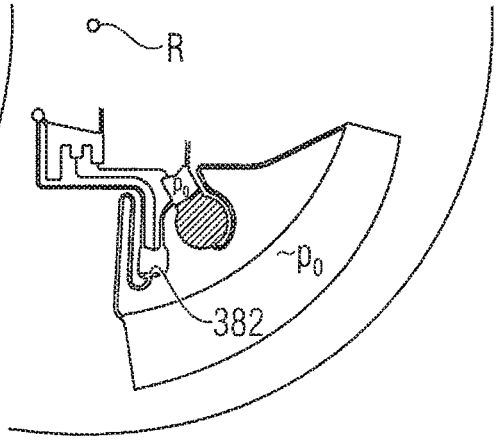

If further liquid volume is introduced into the first fluid chamber 300, for example via channels 308 and/or 312, the liquid volume in the first fluid chamber 300 rises until excess volume flows into the second fluid chamber 302 via the connecting channel 304 representing an overflow. For that purpose, the orifice of the connecting channel into the first fluid chamber 300 is located radially further inside than a radial outer end of the first fluid chamber 300. The excess liquid volume 382 flowing over into the second fluid chamber 302 hermetically closes the gas guidance path 324 leading into the second fluid chamber 302 at a radial outer end. Thus, both fluid paths 320 and 324 to the downstream fluidic structures are hermetically closed after the liquid guidance path 322 has already been hermetically closed when introducing the liquid volume 380 into the first fluid chamber 300. This operating state is shown in FIG. 10B.

Figure 10C:
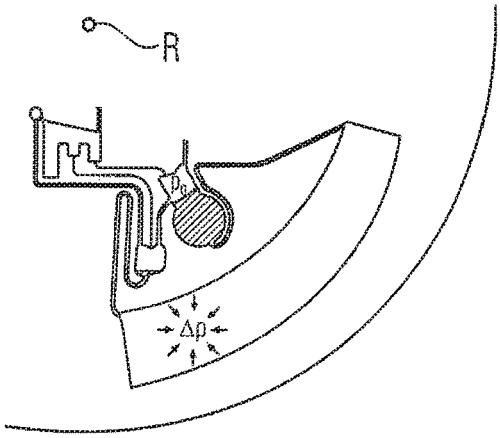
Figure 10D:
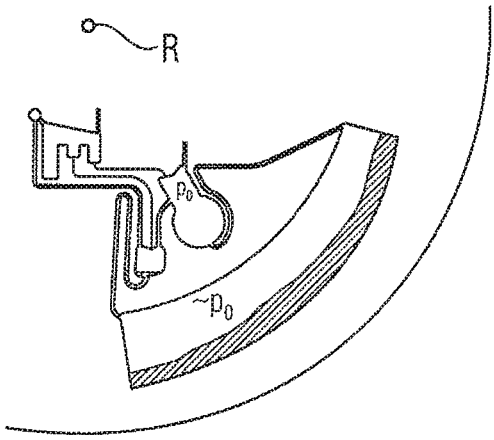

Starting from this operating state, as already described above with reference to FIG. 8A to 8B, negative pressure can be generated in the downstream fluidic structures 322 by reducing the temperature and respective reduction of the pressure as shown in FIG. 10C. As also described with reference to FIGS. 8A and 8E, subsequently, by reducing the centrifugal pressure and/or by reducing the pressure in the subsequent fluidic structures further, it can be effected that the liquid is transferred into the downstream fluidic structures 322 via the liquid guidance path 320 as shown in FIG. 10D. Here, the siphon channel of the liquid guidance path 320 is configured such that, for example when reducing the temperature and thereby induced reduction of the pressure, only this siphon switches, such that only the liquid from the first fluid chamber 300 and not the liquid from the second fluid chamber 302 is transferred. A potential overpressure in the downstream fluidic structures 322 due to the transfer of liquid from the first fluid chamber 300 presses liquid from the gas guidance channel 324 back into the second fluid chamber 302, whereby air can escape through the second fluid chamber 302 in the form of air bubbles rising through the liquid. Thus, the entire liquid can be transferred from the first fluid chamber 300 into the downstream fluidic structures 322.

At strong negative pressure, the syphon channels of both the liquid guidance path 320 as well as the gas guidance path

324 can be filled with liquid. Thereby, both the liquid in the first fluid chamber 300 and the liquid in the second fluid chamber 302 would be at least partly transferred. By the subsequent transfer of the liquid through the fluid guidance path into the chamber 322, the negative pressure in the chamber 322 can at least be partly compensated. By transferring sufficiently large amounts of liquids, beyond the compensation of the negative pressure, an overpressure can be generated, which results, in one of the syphon channels, in the shown embodiment in the gas guidance channel 324, to a reversal of the flow direction of the liquid, and subsequently to a phase change to gas, whereby gas from the subsequent fluidic structures 322 is vented into the chamber 302.

A configuration as described with reference to FIGS. 9 to 10D can be useful to measure a liquid prior to switching to a predefined volume. Liquid volumes below the target volumes are not switched.

The fluidic structures described with reference to FIG. 9 can also be used to add a second liquid as will be discussed below with reference to FIGS. 11A to 11E.

Figure 11A:
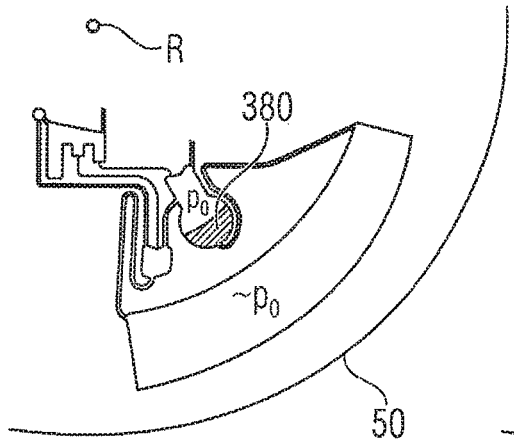
FIGS. 11A-11E are schematic illustrations for illustrating the mode of operation of the embodiment of FIG. 9 when using two liquids.
Figure 11B:
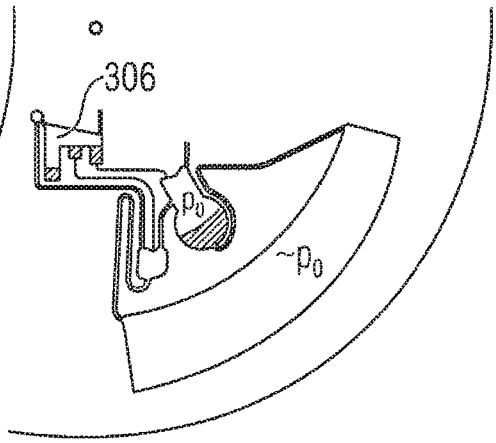

Here, FIG. 11A corresponds to the operating state of FIG. 10A, where a first liquid volume 380 is introduced into the first fluid chamber 300 and is actually stored in the first fluid chamber 300. If a second liquid flows through the inlet channel 310 into the second fluid chamber 302, the subsequent fluidic structures 302 are hermetically closed. Additionally, the second liquid can either flow exclusively into the second fluid chamber 302 via the channel 310, or in a divided manner into the first fluid chamber 300 and the second fluid chamber 302 via channels 308 and 310. The respective supplied volumes can be measured in the chamber segments 306*a* and 306*b* of the upstream fluid chamber 300 as illustrated in FIG. 11B. When the second liquid flows into the first fluid chamber 300 and the second fluid chamber 302, the first and second liquids can be mixed in the first fluid chamber 300.

Figure 11C:
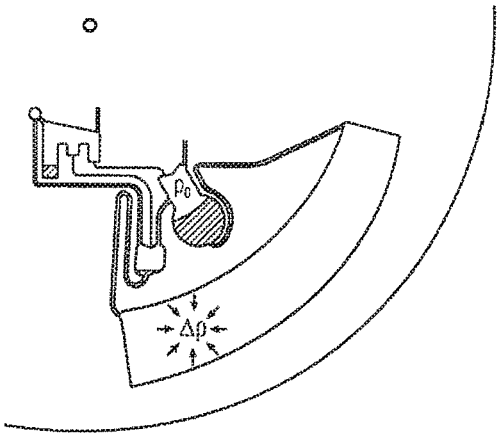
Figure 11D:
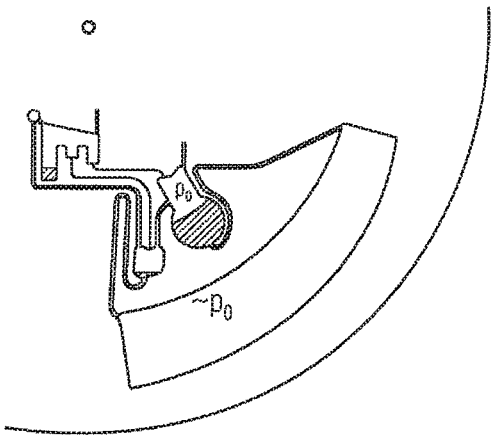
Figure 11E:
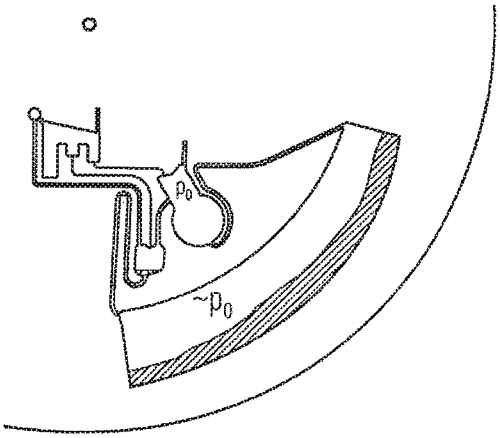

As shown in FIGS. 11C to 11E, subsequently, the liquid can be transferred from the first fluid chamber 300 into the downstream fluidic structures 322 as described above with reference to FIGS. 8A to 8E and 10A to 10B. In particular, the liquid can be transferred into the downstream fluidic structures by reducing the temperature and reducing the pressure accordingly.

Fluidic structures as described with reference to FIGS. 9 to 11E can, in particular, be useful to store a first liquid in a first fluid chamber of a fluid-retaining area, while a second liquid still passes through further independent process steps. These process steps can generally use rotational frequencies and temperatures freely without the liquid in the first fluid chamber 300 being switched via the liquid guidance path 320. After processing, the second liquid can be added in the first fluid chamber 300 and the second fluid chamber 302. The resulting liquid mixture can then be advanced by reducing the temperature.

It is obvious for persons skilled in the art that during the described usage of negative pressure, the fluid chamber of the fluid-retaining area can also be divided into three or more chambers. In embodiments, the different chambers of the liquid retaining area do not have to be connected via channels, except the connection via the downstream fluidic structures and the connecting channels connecting the fluid chamber to the downstream fluidic structures.

Generally, in embodiments, the liquid guidance path leads into a liquid receiving chamber of the subsequent fluidic structures located at a position radially outside a position where the liquid guidance path leads into a fluid chamber of the liquid retaining area. In other words, the liquid guidance path generally comprises a radial incline. Thus, it is possible to transfer the liquid from the respective chamber of the liquid retaining area into the subsequent fluidic structures via the liquid guidance path comprising a syphon channel via a syphon crest, which is arranged radially inside the orifice of the liquid guidance path into the fluid chamber of the liquid retaining area.

In embodiments, the downstream fluidic structures can comprise at least one liquid-receiving chamber into which the liquid is transferred. In embodiments, the liquid retaining area can comprise at least one fluid chamber from which liquid is transferred into the downstream fluidic structures.

In embodiments, the fluidic structures are configured such that centrifugal pressures and pneumatic pressure have a superior role while capillary forces can be negligible. In embodiments, the respective fluid paths can be configured as fluid channels, wherein chambers, for example partial compression chambers, can be arranged in the fluid paths.

Thus, embodiments provide fluidic modules, apparatuses and methods wherein two fluid connecting paths are provided between a chamber in which liquid is retained prior to switching and a target structure for the liquid after the switching process. This allows an almost liquid-characteristic independent monolithic realization of a structure for switching liquid while selectively exceeding or falling below a high rotational frequency of the cartridge. Embodiments provide a centrifugo-pneumatic vent syphon valve comprising fluidic structures on a centrifugal test carrier. The fluidic structures can comprise a first number of chambers, subsequent fluidic structures, as well as at least two fluid paths connecting the first number of chambers to the subsequent fluidic structures. At least one of the fluid paths between the first number of chambers and the subsequent fluidic structures includes a syphon channel, wherein the connection via the fluid paths from the first number of chambers to the subsequent fluidic structures is arranged such that when filling the first number of chambers with liquid, a state can be established in which a gas volume enclosed by the liquid results in the subsequent fluidic structures or a quasi-enclosed gas volume results, wherein the subsequent structures comprise venting with a vent delay resistor. In embodiments of such fluidic structures, a syphon channel is provided in at least one of the fluid-connecting paths between the first number of chambers and the subsequent fluidic structures, wherein the syphon crest is located within the radial outermost position of a first chamber into which the syphon channel leads. In embodiments of such fluidic structures, the subsequent fluidic structures are not vented. In embodiments, the number of chambers can include one chamber or more than one chamber.

Embodiments provide a method for retaining and switching liquids by using a respective centrifugo-pneumatic vent syphon valve, wherein one or several liquids are retained in a liquid retaining area (a first number of chambers) in a quasi-static equilibrium dominated by centrifugal pressures and pneumatic pressures, such that subsequent initiation of a transfer of at least one liquid from the liquid retaining area into the subsequent fluidic structures is merely possible by changing the acting centrifugal and/or pneumatic pressures. In embodiments of such a method, during the transfer of liquid from the liquid retaining area into the subsequent fluidic structures, gas is transferred from the subsequent fluidic structures in a direction of the liquid retaining area via at least one fluid path. In embodiments of such a method, during the transfer of liquid from the liquid retaining area into the subsequent fluidic structure, at least one fluid connecting path between the liquid retaining area and the subsequent fluidic structures is not completely filled with liquid. In embodiments of such a method, the amount of gas in the subsequent fluidic structures is not changed by a fluid path connected to the environment, while liquid is retained in the liquid retaining areas. In embodiments of such a method, liquid in the liquid retaining area is retained in the subsequent fluidic structures due to a pneumatic negative pressure in the subsequent fluidic structures prior to initiating the transfer. In embodiments of such a method, liquid is retained in the liquid retaining area due to a pneumatic overpressure in the subsequent fluidic structures prior to initiating the transfer.

Embodiments can comprise any variations and combinations of the shown schematic embodiments and are not limited by the same.

Although features of the embodiment of the invention have been described above based on a method or based on an apparatus, it is obvious that the described apparatus features also represent features of a respective method and the described method features also represent features of a respective apparatus that can be configured to provide respective functionalities.

Thus, embodiments of the invention provide methods and apparatuses for switching liquid by using a centrifugo-pneumatic vent syphon valve comprising fluidic structures as described herein. Contrary to conventional technology, embodiments of the described structure can fulfill, in connection with the described method in the field of centrifugal microfluidics, several requirements for the unity operations of retaining and later specific switching of liquid at the same time. Embodiments allow monolithic realization of the allocated fluidic structures in a centrifugal microfluidic cartridge. Embodiments offer the option of configuring the structure such that the functional principle is almost independent with respect to liquid and cartridge material characteristics. This includes, in particular, the angle of contact between liquid and cartridge material, as well as the viscosity and surface tension of the liquid. Embodiments offer the option of further adaptations of the fluidic structures in order to determine the processing conditions for triggering a switching process within broad limits. The adaptation options can, in particular, relate to the option of free selection of the gas volume transferred into the subsequent fluidic structures and the pneumatic overpressure generated thereby.

Embodiments offer the option of initiating the switching process by using different variations of the processing conditions. This includes, in particular, rotational frequencies, temperatures and waiting times (when using a vent delay resistor) during processing. Embodiments offer the option, by falling back on temperature variations depending on the process control, of switching a liquid when the rotational frequency rises above a threshold frequency or when the same falls below a threshold frequency. Embodiments offer the option of producing the microfluidic structures without sharp edges, i.e. with low demands on the production methods, such as injection molding and injection embossing. Embodiments of the invention allow the avoidance of strongly rising pneumatic pressures in the fluidic target volume during the transfer of liquid after the switching process. Embodiments offer the option of cascading the fluidic structures. Finally, embodiments offer the option of multi-usage of the fluidic structures in order to retain several liquids after one another and to switch the same specifically.

Embodiments of the invention are configured to change the ratio of centrifugal pressure to pneumatic pressure in order to exceed a threshold, wherein a syphon crest of the syphon channel in the first fluid path is overcome, such that transferring the liquid from the liquid retaining area into the subsequent fluidic structures takes place.

Embodiments of the invention describe variations of the fluidic structures and allocated methods showing different options for influencing the equilibrium of the pressures acting in the direction of or against the initiation of the inventive switching process. Embodiments of the invention are further based on the knowledge that the described switching principle can be easily combined with other operations on the same centrifugal microfluidic platform, for example by guiding liquid into an inventive structure after preceding fluidic operations or by cascading the described switching structure.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Method for switching liquid from a liquid retaining area into downstream fluidic structures by using a fluidic module, the module comprising: a liquid retaining area into which liquid can be introduced, at least two fluid paths fluidically connecting the liquid retaining area to downstream fluidic structures, wherein at least a first fluid path of the at least two fluid paths comprises a syphon channel, wherein a syphon crest of the syphon channel is located radially inside of a radial outermost position of the liquid retaining area, wherein the syphon crest is an area of the syphon channel with minimum distance to the center of rotation, wherein the downstream fluidic structures are at most vented via a vent delay resistor when the liquid is introduced into the liquid retaining area, such that an enclosed gas volume or a gas volume merely vented via the vent delay resistor results in the downstream fluidic structures when the liquid is introduced into the liquid retaining area, and a ratio of a centrifugal pressure effected by a rotation of the fluidic module to a pneumatic pressure prevailing in the gas volume at least temporarily prevents the liquid from reaching the downstream fluidic structures through the at least two fluid paths, wherein transfer of at least part of the liquid to the downstream fluidic structures through the first fluid path and venting of at least part of the gas volume into the liquid retaining area through a second fluid path of the at least two fluid paths is effected by changing the ratio of the centrifugal pressure to the pneumatic pressure, the method comprising: introducing at least one liquid into the liquid retaining area and retaining the liquid in the liquid retaining area by rotating the fluidic module, such that the liquid is retained in the liquid retaining area in a quasi-stationary equilibrium dominated by the centrifugal pressure and the pneumatic pressure; and changing the ratio of the centrifugal pressure to the pneumatic pressure in order to transfer the liquid at least partly through the first fluid path into the downstream fluidic structures and to vent the gas volume at least partly into the liquid retaining area through the second fluid path of the two at least fluid paths, wherein a) retaining the liquid in the liquid retaining area comprises generating a pneumatic overpressure in the downstream fluidic structures prior to initiating the transfer, and changing the ratio of the centrifugal pressure to the pneumatic pressure comprises increasing the rotational speed of the fluidic module, increasing the hydrostatic height of the liquid and/or reducing the pneumatic pressure, or b) retaining the liquid in the liquid retaining area comprises generating a negative pressure in the downstream fluidic structures in order to adjust and retain menisci in the liquid retaining area and the first and second fluid paths without transferring the liquid into the downstream fluidic structures through the first fluid path, and wherein changing the ratio of the centrifugal pressure to the pneumatic pressure comprises reducing the rotational speed of the fluidic module and/or reducing the pneumatic pressure in the downstream fluidic structures.

2. Method according to claim 1, wherein changing the ratio comprises reducing the pneumatic pressure by reducing the temperature in the downstream fluidic structures, increasing the volume of the downstream fluidic structures and/or reducing the amount of gas in the downstream fluidic structures.

3. Method according to claim 1, wherein the second fluid path is not completely filled with liquid during the transfer of the liquid through the first fluid path.

4. Method according to claim 1, wherein the amount of the gas in the downstream fluidic structures is not changed while the liquid is retained in the liquid retaining area.

5. Method according to claim 1, wherein the second fluid path of the at least two fluid paths is a venting channel for the downstream fluidic structures closed from the liquid when the liquid is introduced into the liquid retaining area.

6. Method according to claim 1, wherein the first fluid path leads into the liquid retaining area in a radial outer area or at a radial outer end, wherein the liquid retaining area is emptied via the first fluid path, at least up to the area where the first fluid path leads into the liquid retaining area.

7. Method according to claim 1, wherein the liquid retaining area comprises a first fluid chamber, wherein the first fluid path leads into the first fluid chamber in a radial outer area of the first fluid chamber or at a radial outer end of the first fluid chamber.

8. Method according to claim 7, wherein the first fluid chamber is at most vented via an additional vent delay resistor or the vent delay resistor when the liquid is introduced into the liquid retaining area, such that a gas volume enclosed in the first fluid chamber and the downstream fluidic structures or a gas volume merely vented via the vent delay resistor results when the liquid is introduced into the liquid retaining area.

9. Method according to claim 7, wherein the liquid retaining area further comprises a second fluid chamber into which liquid is introduced by a centrifugal pressure effected by the rotation of the fluidic module, wherein the first fluid path leads into the first fluid chamber and the second fluid path leads into the second fluid chamber, and wherein the second fluid path is closed by liquid introduced into the second fluid chamber.

10. Method according to claim 9, wherein the first fluid chamber and the second fluid chamber are fluidically connected via a connecting channel whose orifice into the first fluid chamber is located radially further inside than a radial outer end of the first fluid chamber, such that liquid from the first fluid chamber flows over into the second fluid chamber when the filling level of the liquid in the first fluid chamber reaches the orifice and closes the second fluid path leading into the second fluid chamber.

11. Method according to claim 1, wherein the second fluid path comprises a siphon channel.

12. Method according to claim 11, wherein the second fluid path leads into the liquid retaining area in a radial outer area of the liquid retaining area.

13. Method according to claim 12, wherein a crest of the siphon channel of the second fluid path is located radially further inside than a crest of the siphon channel of the first fluid path.

14. Method according to claim 12, wherein a fluid intermediate chamber is arranged in the second fluid path between the crest of the siphon channel of the second fluid path and an orifice of the second fluid path into the liquid retaining area, wherein the fluid intermediate chamber is at least partly filled with the liquid when the liquid is introduced into the liquid retaining area.

15. Method according to claim 1, wherein the downstream fluidic structures comprise at least one downstream fluid chamber into which the first fluid path leads.

16. Method according to claim 15, wherein the first fluid path leads into the at least one downstream fluid chamber radially further outside than the second fluid path.

17. Method according to claim 15, wherein the at least one downstream fluid chamber is a first downstream fluid chamber and the downstream fluidic structures comprise a second downstream fluid chamber fluidically connected to the first downstream fluid chamber via at least a third fluid path.

18. Method according to claim 17, wherein the first downstream fluid chamber is fluidically connected to the second downstream fluid chamber via a third fluid path and a fourth fluid path, wherein at least the third fluid path comprises a siphon channel, wherein the third fluid path and the fourth fluid path are closed by the liquid when the liquid reaches the first downstream fluid chamber of the downstream fluidic structures through the first fluid path due to a change of the ratio of the centrifugal pressure to the pneumatic pressure, wherein an enclosed gas volume or a gas volume vented merely via an additional vent delay resistor or the vent delay resistor results in the second downstream fluid chamber and a ratio of the centrifugal pressure to the pneumatic pressure prevailing in the gas volume in the second downstream fluid chamber at least temporarily prevents the liquid from reaching the second downstream fluid chamber through the fluid paths, wherein it can be effected by changing the ratio of the centrifugal pressure to the pneumatic pressure in the second downstream fluid chamber that the liquid at least partly reaches the second downstream fluid chamber through the third fluid path and the gas volume is vented from the second downstream fluid chamber at least partly into the liquid retaining area through the fourth fluid path.

* * * * *